US006392561B1

(12) United States Patent
Davies et al.

(10) Patent No.: US 6,392,561 B1
(45) Date of Patent: May 21, 2002

(54) SHORT HOP TELEMETRY SYSTEM AND METHOD

(75) Inventors: Evan L. Davies, Edmonton; Gary L. Donison, Sherwood Park; Boguslaw Wiecek, Edmonton, all of (CA)

(73) Assignee: Dresser Industries, Inc., Houston, TX (US)

( * ) Notice: Subject to any disclaimer, the term of this patent is extended or adjusted under 35 U.S.C. 154(b) by 0 days.

(21) Appl. No.: 09/217,949

(22) Filed: Dec. 22, 1998

(51) Int. Cl.[7] ..... G01V 3/00

(52) U.S. Cl. ..... 340/854.3; 340/853.3; 340/855.1; 340/855.2; 367/82

(58) Field of Search ..... 340/853.3, 854.3, 340/854.4, 854.6, 854.9, 855.1, 855.2; 367/81, 82

(56) References Cited

U.S. PATENT DOCUMENTS

| | | | | |
|---|---|---|---|---|
| 3,170,137 A | * | 2/1965 | Brandt | 340/855.1 |
| 4,057,781 A | * | 11/1977 | Scerbatskoy | 340/854.9 |
| 4,431,964 A | | 2/1984 | Walkow | |
| 4,496,174 A | | 1/1985 | McDonald et al. | |
| 4,529,939 A | | 7/1985 | Kuckes | |
| 4,605,268 A | * | 8/1986 | Meador | 340/855.2 |
| 4,691,203 A | | 9/1987 | Rubin et al. | |
| 4,725,837 A | | 2/1988 | Rubin | |
| 5,160,925 A | | 11/1992 | Dailey et al. | |
| 5,163,521 A | | 11/1992 | Pustanyk et al. | |
| 5,359,324 A | | 10/1994 | Clark et al. | |
| 5,410,303 A | | 4/1995 | Comeau et al. | |
| 5,602,541 A | | 2/1997 | Comeau et al. | |

FOREIGN PATENT DOCUMENTS

| | | |
|---|---|---|
| EP | 0540425 B1 | 9/1996 |
| WO | WO92/18882 | 10/1992 |

OTHER PUBLICATIONS

Sperry–Sun Drilling Services Inc., catalogue entitled "Sourcebook," 1996, pp. 33–44 ("Measurement–While–Drilling Systems").

Sperry–Sun Drilling Services, Inc., "Sperry Drill Technical Information Handbook," undated, pp. 2–17.

* cited by examiner

*Primary Examiner*—Timothy Edwards
(74) *Attorney, Agent, or Firm*—Terrence N. Kuharchuk; Michael D. McCully; William Shull

(57) ABSTRACT

The invention relates to a data transmission or telemetry system and a method for communicating information axially along a drill string. The method includes the step of conducting an axial electrical signal embodying the information between a first axial position in the drill string and a second axial position in the drill string through an axial conducting loop formed by the drill string, which axial conducting loop extends between the first and second axial positions. The system includes the axial conducting loop for conducting the axial electrical signal embodying the information between the first and second axial positions and a transmitter for transmitting the information to the axial conducting loop. The system further preferably includes a receiver for receiving the information from the axial conducting loop. Finally, the portion of the drill string forming the axial conducting loop is preferably comprised of a downhole motor drilling assembly.

41 Claims, 8 Drawing Sheets

SHORT HOP TELEMETRY SYSTEM AND METHOD

FIELD OF INVENTION

The present invention relates to a downhole data transmission or telemetry system and method for communicating information axially along a drill string. More particularly, the present invention relates to a downhole short hop telemetry system and method, to be used with a measurement-while-drilling (MWD) system, for communicating information unidirectionally or bidirectionally between a sensor located near a drilling bit and the system axially along or through the components of the drill string.

BACKGROUND OF INVENTION

Directional drilling involves controlling the direction of a borehole as it is being drilled. Since boreholes are drilled in three dimensional space, the direction of a borehole includes both its inclination relative to vertical as well as its azimuth. Usually the goal of directional drilling is to reach a target subterranean destination with the drill string, typically a potential hydrocarbon producing formation.

In order to optimize the drilling operation, it is often desirable to be provided with information concerning the environmental conditions of the surrounding formation being drilled and information concerning the operational and directional parameters of the downhole motor drilling assembly including the drilling bit. For instance, it is often necessary to adjust the direction of the borehole frequently while directional drilling, either to accommodate a planned change in direction or to compensate for unintended and unwanted deflection of the borehole. In addition, it is desirable that the information concerning the environmental, directional and operational parameters of the drilling operation be provided to the operator on a real time basis. The ability to obtain real time data measurements while drilling permits a relatively more economical and more efficient drilling operation.

For example, the performance of the downhole motor drilling assembly, and in particular the downhole motor, and the life of the downhole motor may be optimized by the real time transmission of the temperature of the downhole motor bearings or the rotations per minute of the drive shaft of the motor. Similarly, the drilling operation itself may be optimized by the real time transmission of environmental or borehole conditions such as the measurement of natural gamma rays, borehole inclination, borehole pressure, resistivity of the formation and weight on bit. Real time transmission of this information permits real time adjustments in the operating parameters of the downhole motor drilling assembly and real time adjustments to the drilling operation itself.

Accordingly, various measurement-while-drilling (MWD) systems have been developed that permit downhole sensors to measure real time drilling parameters and to transmit the resulting information or data to the surface substantially instantaneously with the measurements. For instance, MWD mud pulse telemetry systems transmit signals from an associated downhole sensor to the surface through the drilling mud in the drill string. More particularly, pressure or acoustic pulses, modulated with the sensed information from the downhole sensor, are applied to the mud column and are received and demodulated at the surface. The downhole sensor may include various sensors such as gamma ray, resistivity, porosity or temperature sensors for measuring formation characteristics or other downhole parameters. In addition, the downhole sensor may include one or more magnetometers, accelerometers or other sensors for measuring the direction or inclination of the borehole, weight-on-bit or other drilling parameters.

Typically, MWD systems, such as the MWD mud pulse telemetry system, are located above the downhole motor drilling assembly. For instance, when used with a downhole motor, the MWD mud pulse telemetry system is typically located above the motor so that it is spaced a substantial distance from the drilling bit in order to protect or shield the electronic components of the MWD system from the effects of any vibration or centrifugal forces emanating from the drilling bit. Further, the downhole sensors associated with the MWD system are typically placed in a non-magnetic environment by utilizing monel collars in the drill string below the MWD system.

Thus, the MWD system may be located a significant distance from the drilling bit. As a result, the environmental information measured by the MWD system may not necessary correlate with the actual conditions surrounding the drilling bit. Rather, the MWD system is responding to conditions which are substantially spaced from the drilling bit. For instance, a conventional MWD system may have a depth lag of up to or greater than 60 feet. As a result of this information delay, it is possible to drill completely through a potential hydrocarbon producing formation before detecting its presence, requiring costly corrective procedures.

In response to this undesirable information delay or depth lag, various near bit sensor systems or packages have been developed which are designed to be placed adjacent or near the drilling bit. The near bit system permits the detection of the potential hydrocarbon producing formation almost immediately upon its penetration, minimizing the need for unnecessary drilling and service costs. The drilling operation, including the trajectory of the drilling bit, may then be adjusted in response to the sensed information.

However, in order to use a near bit sensor system and permit real time monitoring and adjustment of drilling parameters, a system or method must be provided for transmitting the measured data or sensed information from the downhole sensor either directly to the surface or to a further MWD system for subsequent transmission to the surface. Various attempts have been made in the prior art to transmit the information directly or indirectly to the surface. However, none of these attempts have provided a fully satisfactory solution.

Various systems have been developed for communicating or transmitting the information directly to the surface through an electrical line, wireline or cable to the surface. These hard-wire connectors provide a hard-wire connection from the drilling bit to the surface, which has a number of advantages. For instance, these connections typically permit data transmission at a relatively high rate and permit two-way or bidirectional communication. However, these systems also have several disadvantages.

First, a wireline or cable must be installed in or otherwise attached or connected to the drill string. This wireline or cable is subject to wear and tear during use of the system and thus, may be prone to damage or even destruction during normal drilling operations. For instance, the downhole motor drilling assembly may not be particularly suited to accommodate such wirelines running through the motor, with the result that the wireline sensors may not usually be located in close proximity to the drilling bit. Further, the wireline may be exposed to excessive stresses at the point of connection between the sections of drill pipe comprising the drill string. As a result, the system may be somewhat unreliable and prone to failure, which may result in costly inspection, servicing and replacement of the wireline. In addition, the presence of the wireline or cable may require a change in the usual drilling equipment and operational procedures. The downhole motor drilling assembly may need to be particularly designed to accommodate the wireline. As well, the wireline may need to be withdrawn and replaced each time a joint of pipe is added to the drill string. These disadvantages result in a relatively complex and unreliable system for transmitting the sensed information.

Systems have also been developed for the transmission of acoustic or seismic signals or waves through the drill string or surrounding formation. The acoustic or seismic signals are generated by a downhole acoustic or seismic generator. However, a relatively large amount of power is typically required downhole in order to generate a sufficient signal such that it is detectable at the surface. In order to be able to generate a sufficient signal, the necessary power may be supplied to the generator by a hard wire connection from the surface to the downhole generator. Alternately, a relatively large power source must be provided downhole.

U.S. Pat. No. 5,163,521 issued Nov. 17, 1992 to Pustanyk et. al., U. S. Pat. No. 5,410,303 issued Apr. 25, 1995 to Comeau et. al., and U.S. Pat. No. 5,602,541 issued Feb. 11, 1997 to Comeau et. al. all describe a MWD tool, a downhole motor having a bearing assembly and a drilling bit. A sensor and a transmitter are provided in a sealed cavity within the housing of the downhole motor bearing assembly, adjacent the drilling bit. A signal from the sensor is transmitted by the transmitter to a receiver in the MWD tool. The MWD tool then transmits the information to the surface. The signals are transmitted from the transmitter to the receiver by a wireless system. Specifically, the information is transmitted by frequency modulated acoustic signals indicative of the sensed information. Preferably, the transmitted signals are acoustic signals having a frequency in the range of from 500 to 2000Hz. However, alternatively, radio frequency signals of up to 3000 mega-Hz may be used.

Further systems have been developed which require the transmission of electromagnetic signals through the surrounding formation. Electromagnetic transmission of the sensed information often involves the use of a toroid positioned adjacent the drilling bit for generation of an electromagnetic wave through the formation. Specifically, a primary winding, carrying the sensed information, is wrapped around the toroid and a secondary winding is formed by the drill string. A receiver may be either connected to the ground at the surface for detecting the electromagnetic wave or may be associated with the drill string at a position uphole from the transmitter.

Generally speaking, as with acoustic and seismic signal transmission, the transmission of electromagnetic signals through the formation typically requires a relatively large amount of power, particularly where the electromagnetic signal must be detectable at the surface. Further, attenuation of the electromagnetic signals as they are transmitted through the formation is increased with an increase in the distance over which the signals must be transmitted, an increase in the data transmission rate and an increase in the electrical resistivity of the formation. The conductivity and the heterogeneity of the surrounding formation may particularly adversely affect the propagation of the electromagnetic radiation through the formation. As well, noise in the drill string, particularly from the downhole motor drilling assembly, may interfere with the detection of the electromagnetic signals.

Thus, as with acoustic and seismic signal transmission, in order to be able to generate a sufficient electromagnetic signal, the necessary power may need to be supplied to a downhole electromagnetic generator by a hard wire connection from the surface. Alternately, a relatively large power source may be provided downhole.

Finally, when utilizing a toroid for the transmission of the electromagnetic signal, the outer sheath of the drill string must protect the windings of the toroid while still providing structural integrity to the drill string. This is particularly important given the location of the toroid in the drill string since the toroid is often exposed to large mechanical stresses during the drilling operation. Further, in order to avoid short circuiting of the system or a short circuit turn of the signals through the drill string and in order to enhance the propagation of the electromagnetic radiation through the surrounding formation, an electrical discontinuity is provided in the drill string. The electrical discontinuity typically comprises an insulative gap or insulated zone provided in the drill string. The insulative gap may be provided by an insulating material comprising a substantial area of the outer sheath or surface of the drill string. For instance, the insulating material may extend for ten to thirty feet along the drill string. Thus, the need for the insulative gap to be incorporated into the drill string may interfere with the structural integrity of the drill string resulting in a weakening of the drill string at the gap. Further, the insulating material provided for the insulative gap may be readily damaged during typical drilling operations.

Various attempts have been made in the prior art to address these difficulties or disadvantages associated with electromagnetic transmission systems. However, none of these attempts have provided a fully satisfactory solution.

U.S. Pat. No. 4,496,174 issued Jan. 29, 1985 to McDonald et. al. and U.S. Pat. No. 4,725,837 issued Feb. 16, 1988 to Rubin disclose an insulated drill collar gap sub assembly for a toroidal coupled telemetry system. The sub assembly provides a dielectric material in the insulative gap, while attempting to enhance the structural integrity of the sub assembly at the gap. Although the sub assembly may enhance the structural integrity of the drill string, the system still requires the propagation of the electromagnetic radiation through the formation to the surface. Specifically, electromagnetic waves are launched from a transmitting toroid in the form of electromagnetic waves traveling through the earth. These waves eventually penetrate the earth's surface and are picked up by an uphole receiving system. The uphole receiving system comprises a plurality of radially extending arms of electrical conductors about the drilling platform, which are laid on the ground surface and extend for three to four hundred feet away from the drill site. These receiving arms intercept the electromagnetic waves and send the corresponding signals to a receiver.

U.S. Pat. No. 4,691,203 issued Sep. 1, 1987 to Rubin et. al. is directed at a downhole telemetry apparatus for transmitting electromagnetic signals to the surface. The apparatus includes a mode transducer designed to avoid the need for a toroidal transformer. The transducer provides a total electrical discontinuity in the drill string so that a potential difference can be produced across adjacent conducting faces of the drill string. Essentially, the adjacent conducting faces of the drill string are separated from each other by a predetermined insulative gap. Insulation around the gap is selected to induce optimum earth currents when the electrical signal is applied across the faces. Once the signal crosses the insulative gap, it is conducted to the surface through an upper portion of the drill string, where it is transferred from the drill string through a wire to an input transformer for a surface receiver. Once flowing through the transformed primary, the signal is transmitted through a wire installed in the ground near the surface. The electrical signal from the wire propagates through the earth back to the downhole sensor unit and finally completes its path into the mode transducer.

U.S. Pat. No. 5,160,925 issued Nov. 3, 1992 to Dailey et. al. and PCT International Application PCT/US92/03183 published Oct. 29, 1992 as WO 92/18882 are directed at a short hop communication link for a downhole MWD system. The system comprises a sensor module, a control module, a host module and a mud pulser. The sensor module includes a transmitter for transmitting an electromagnetic signal, indicative of the information measured by the sensor, to the control module and a receiver for receiving commands from the control module. The control module includes a transceiver for transmitting command signals and receiving signals from the sensor module. Further, the control module transmits electrical signals to the host module through a hard wire connection, which similarly connects to the mud pulser.

Both the sensor and control modules include an antenna arrangement through which the electromagnetic signals are sent and received through a short hop communication link. The sensor and control antennas are transformercoupled, insulated gap antennas. More particularly, communication between the sensor and control modules is effected by electromagnetic propagation through the surrounding conductive earth. The signal is impressed across an insulated axial gap in the outer diameter of the drill string, represented by the antennas, either by transformer coupling or by direct drive across a fully insulated gap in the assembly. The electromagnetic wave from the antenna propagates through the surrounding conductive earth, accompanied by a current in the metal drill string. As the formation conductance increases and resistance decreases, the maximum frequency with acceptable attenuation will decrease. Preferably, a frequency in the range of about 100 to 10,000 Hz is used.

U.S. Pat. No. 5,359,324 issued Oct. 25, 1994 to Clark et. al. and European Patent Specification EP 0 540 425 B1 published Sep. 25, 1996 are directed at an apparatus for determining earth formation resistivity and sending the information to the surface. The apparatus utilizes a first toroidal coil antenna mounted, in an insulating medium, on a drill collar for transmitting and/or receiving modulated information signals which travel through the surrounding earth formation. A second toroidal coil antenna is also mounted, in an insulating medium, on the drill collar for transmitting and/or receiving the modulated information signals to and from the first antenna.

Therefore, there remains a need in the industry for a real time data transmission or telemetry system and method for communicating information axially along a drill string. Further, there is a need for a telemetry system and method that communicate or transmit data measurements or sensed information a relatively short distance through components of the drill string. Still further, there is a need for the downhole short hop telemetry system and method to communicate information either unidirectionally or bidirectionally axially along or through the components of the drill string. Preferably, the system and method overcome or minimize the disadvantages or difficulties associated with previously known downhole telemetry systems and methods.

SUMMARY OF INVENTION

The present invention relates to a data transmission or telemetry system and a method for communicating information axially along a drill string. Further, the present invention relates to a downhole short hop real time telemetry system and a method, to be used with a downhole measurement-while-drilling (MWD) system, for communicating information axially along or through the components of the drill string. Preferably, the system and method are capable of communicating the information, unidirectionally or bidirectionally, between a downhole sensor located near a drilling bit of the drill string and the MWD system. Further, the system and method preferably communicate the information from the sensor to the MWD system through a downhole motor drilling assembly comprising the drill string. Specifically, the downhole motor drilling assembly preferably provides a closed axial conducting loop for transmission of the information.

Preferably, the within invention overcomes or minimizes the disadvantages or difficulties associated with previously known downhole telemetry systems and methods. Thus, the within invention preferably provides for a relatively high data transmission rate and a relatively low power consumption as compared to known systems and methods. Further, as stated, the information is communicated along the drill string or through the components of the drill string, preferably along or through the downhole motor drilling assembly. Thus, the communication of the information is not significantly affected by the conductance or resistance of the surrounding formation, drilling mud or other drilling fluids. As well, the drill string is not required to provide an insulative gap therein.

In one aspect of the invention, the invention comprises a method for communicating information axially along a drill string. The method comprises the step of conducting an axial electrical signal embodying the information between a first axial position in the drill string and a second axial position in the drill string through an axial conducting loop formed by the drill string, which axial conducting loop extends between the first axial position and the second axial position.

The axial conducting loop may be comprised of any portion or section of the drill string along the length of the drill string. Further, the axial conducting loop may be comprised of any of the components or elements comprising the drill string. However, preferably, the drill string between the first axial position and the second axial position comprises an inner axial conductor and an outer axial conductor. Further, preferably, the axial conducting loop is comprised of the inner axial conductor and the outer axial conductor. In this instance, the inner axial conductor and the outer axial conductor are conductively connected with each other at each of the first axial position and the second axial position.

The method may further comprise the steps of: (a) conducting through a transmitter conductor a transmitter electrical signal embodying the information; and (b) inducing from the conducting of the transmitter electrical signal the conducting through the axial conducting loop of the axial electrical signal. As well, the method may further comprise the step of inducing from the conducting of the axial electrical signal the conducting through a receiver conductor of a receiver electrical signal embodying the information.

In addition, before conducting the transmitter electrical signal through the transmitter conductor, the method may comprise the following steps: (a) receiving the information; and (b) generating the transmitter electrical signal. After conducting the receiver electrical signal through the receiver conductor, the method may comprise the step of obtaining the information from the receiver electrical signal.

In the within method, the transmitter electrical signal is comprised of a varying electrical signal. The transmitter electrical signal may be a unipolar varying electrical signal or a bipolar varying electrical signal. However, a unipolar varying electrical signal is preferred. The varying transmitter electrical signal may have any carrier frequency, voltage and current capable of inducing the conducting of the axial electrical signal through the axial conducting loop. Preferably, the transmitter electrical signal is comprised of a varying electrical signal having a carrier frequency of between about 10 kilohertz and about 2 megahertz, and more preferably, about 400 kilohertz. Further, the transmitter electrical signal preferably has a voltage of between about 2 volts (peak to peak) and about 10 volts (peak to peak), and more preferably, about 5 volts (peak to peak).

In another aspect of the invention, the invention comprises a telemetry system for communicating information axially along a drill string. The system comprises:

(a) an axial conducting loop formed by the drill string for conducting an axial electrical signal embodying the information between a first axial position in the drill string and a second axial position in the drill string, which axial conducting loop extends between the first axial position and the second axial position; and (b) a transmitter for transmitting the information to the axial conducting loop.

The axial conducting loop of the system may be comprised of any portion or section of the drill string along the length of the drill string. Further, the axial conducting loop may be comprised of any of the components or elements comprising the drill string. However, preferably, the drill string between the first axial position and the second axial position comprises an inner axial conductor and an outer axial conductor. Further, preferably, the axial conducting loop is comprised of the inner axial conductor and the outer axial conductor.

As well, in the preferred embodiment, the axial conducting loop is further comprised of a first conductive connection between the inner axial conductor and the outer axial conductor at the first axial position and is further comprised of a second conductive connection between the inner axial conductor and the outer axial conductor at the second axial position.

The system also preferably comprises a receiver for receiving the information from the axial conducting loop. In the preferred embodiment, the transmitter is located adjacent to one of the first axial position and the second axial position and the receiver is located adjacent to the other of the first axial position and the second axial position.

Any transmitter capable of transmitting the information to the axial conducting loop may be used. However, the transmitter is preferably comprised of a transmitter conductor for conducting a transmitter electrical signal embodying the information such that conducting of the axial electrical signal in the axial conducting loop will be induced from the conducting of the transmitter electrical signal in the transmitter conductor. As well, the transmitter further preferably comprises a transmitter processor for receiving the information and for generating the transmitter electrical signal.

Similarly, any receiver capable of receiving the information from the axial conducting loop may be used. However, the receiver is preferably comprised of a receiver conductor for conducting a receiver electrical signal embodying the information such that conducting of the receiver electrical signal in the receiver conductor will be induced from the conducting of the axial electrical signal in the axial conducting loop. As well, the receiver further preferably comprises a receiver processor for receiving the receiver electrical signal and for obtaining the information from the receiver electrical signal.

In addition, the transmitter is preferably a transceiver which is capable of both transmitting and receiving the information. Similarly, the receiver is preferably a transceiver which is capable of both transmitting and receiving the information. Thus, although the information may be communicated in one direction only along the drill string, in the preferred embodiment, the information is able to be communicated bidirectionally along the drill string.

In both the method and system of the within invention, the transmitter conductor may be comprised of any conductor capable of conducting the transmitter electrical signal such that conducting of the axial electrical signal in the axial conducting loop will be induced from the conducting of the transmitter electrical signal in the transmitter conductor. Preferably, the transmitter conductor is comprised of a transmitter coil comprising a plurality of windings. Further, the transmitter conductor preferably includes a magnetically permeable toroidal transmitter core and the windings of the transmitter coil are wrapped around the transmitter core. The transmitter coil may include any number of windings compatible with the functioning of the transmitter conductor as described above.

The receiver conductor may be comprised of any conductor capable of conducting the receiver electrical signal embodying the information such that conducting of the receiver electrical signal in the receiver conductor will be induced from the conducting of the axial electrical signal in the axial conducting loop. Preferably, the receiver conductor is comprised of a receiver coil comprising a plurality of windings. Further, the receiver conductor preferably includes a magnetically permeable toroidal receiver core and the windings of the receiver coil are wrapped around the receiver core. The receiver coil may include any number of windings compatible with the functioning of the receiver conductor as described above.

The inner axial conductor and the outer axial conductor may each be comprised of any of the components or elements of the drill string. However, preferably, the drill string is comprised of a downhole motor drilling assembly and the inner and outer axial conductors are each comprised of one or more components of the downhole motor drilling assembly. In the preferred embodiment, the inner axial conductor is comprised of components of a drive train for the downhole motor drilling assembly. The outer axial conductor is comprised of a housing for the downhole motor drilling assembly.

Further, in the preferred embodiment, the downhole motor drilling assembly defines an annular transmitter space between the drive train and the housing and defines an annular receiver space between the drive train and the housing. The transmitter conductor and the receiver conductor are preferably located in the annular transmitter space and the annular receiver space respectively. Further, the transmitter conductor and the receiver conductor are preferably located between the first axial position and the second axial position.

BRIEF DESCRIPTION OF DRAWINGS

Embodiments of the invention will now be described with reference to the accompanying drawings, in which.

DETAILED DESCRIPTION

The present invention relates to a method and system for communicating information axially along a drill string by conducting an axial electrical signal embodying the information between a first axial position in the drill string and a second axial position in the drill string through an axial conducting loop formed by the drill string, which axial conducting loop extends between the first axial position and the second axial position.

The system may be used to communicate information along any length of drill string which is capable of forming the axial conducting loop and may be used to communicate information along the drill string either from the first axial position to the second axial position or from the second axial position to the first axial position. Preferably the system is capable of communicating information in both directions along the drill string so that the information can be communicated either toward the surface or away from the surface of a wellbore in which the drill string is contained.

Information communicated toward the surface using the system may typically relate to drilling operations or to the environment in which drilling is taking place, such as for example weight-on-bit, natural gamma ray emissions, borehole inclination, borehole pressure, mud cake resistivity and so on. Information communicated away from the surface using the invention may typically relate to instructions sent from the surface, such as for example a signal from the surface prompting the system to send information back to the surface or instructions from the surface to alter drilling operations where a downhole motor drilling assembly is being used.

Preferably the invention is used in conjunction with a downhole motor drilling assembly and is preferably used as a component of a measurement-while-drilling ("MWD") system providing communication to and from the surface during drilling operations. The invention is particularly suited for use to provide a "short hop" communications link between sensors located below the power unit of the drilling motor and a surface communications system located above the power unit of the drilling motor. In this specification, the terms "downhole motor drilling assembly" and "drilling assembly" are used interchangeably and both terms include those components of the drill string which are associated with the downhole motor.

The system of the invention is intended to be incorporated into a drill string. In the preferred embodiment, the system is incorporated into a downhole motor drilling assembly and thus forms part of the downhole motor drilling assembly. The downhole motor drilling assembly in turn is incorporated into the drill string during drilling operations so that the downhole motor drilling assembly forms part of the drill string. The system may, however, be incorporated into the drill string so that it is separate from the downhole motor drilling assembly.

Figure 1:
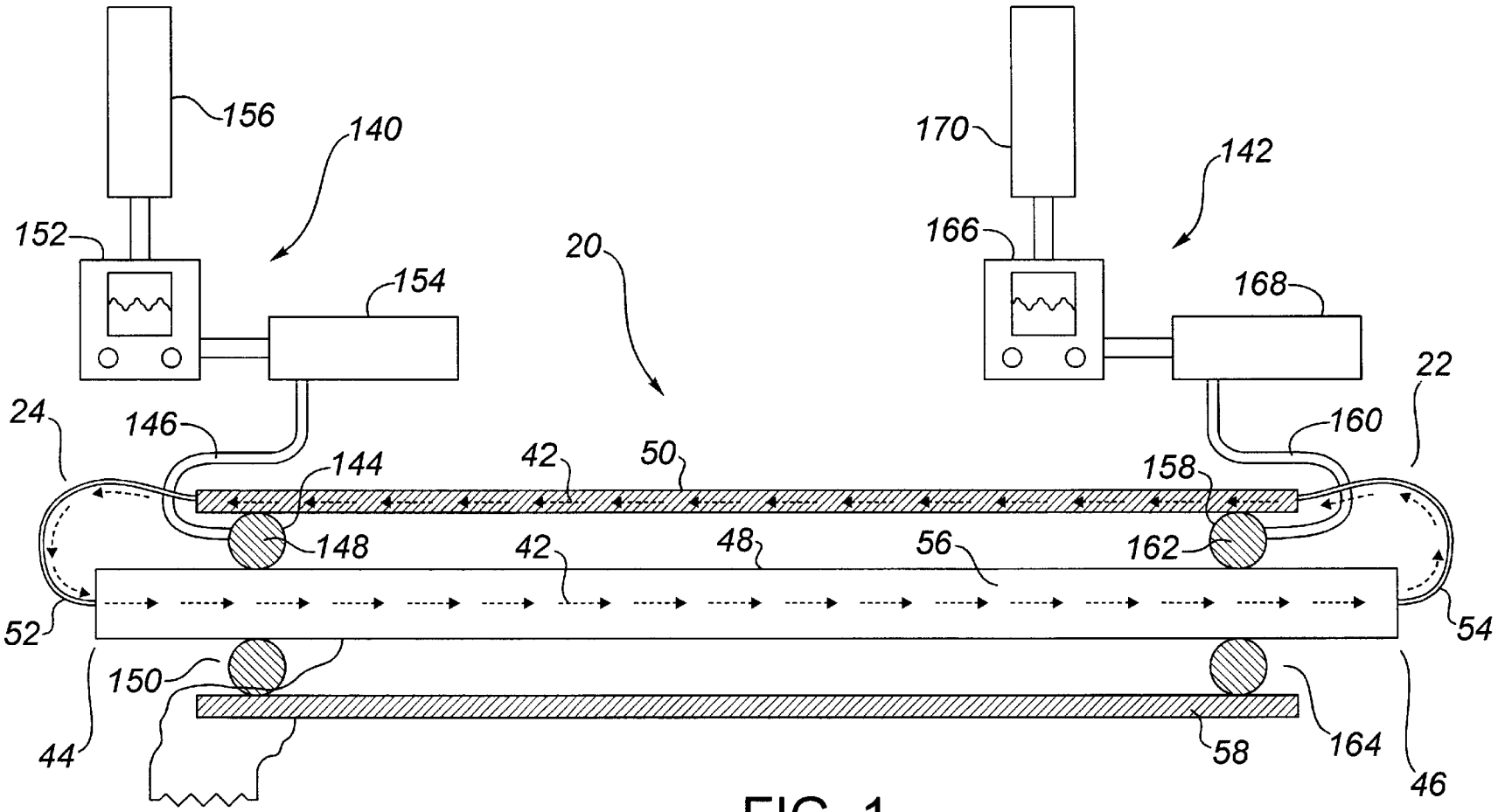
FIG. 1 is a side schematic drawing of a preferred embodiment of a system of the within invention showing an axial conducting loop.
Figure 2:
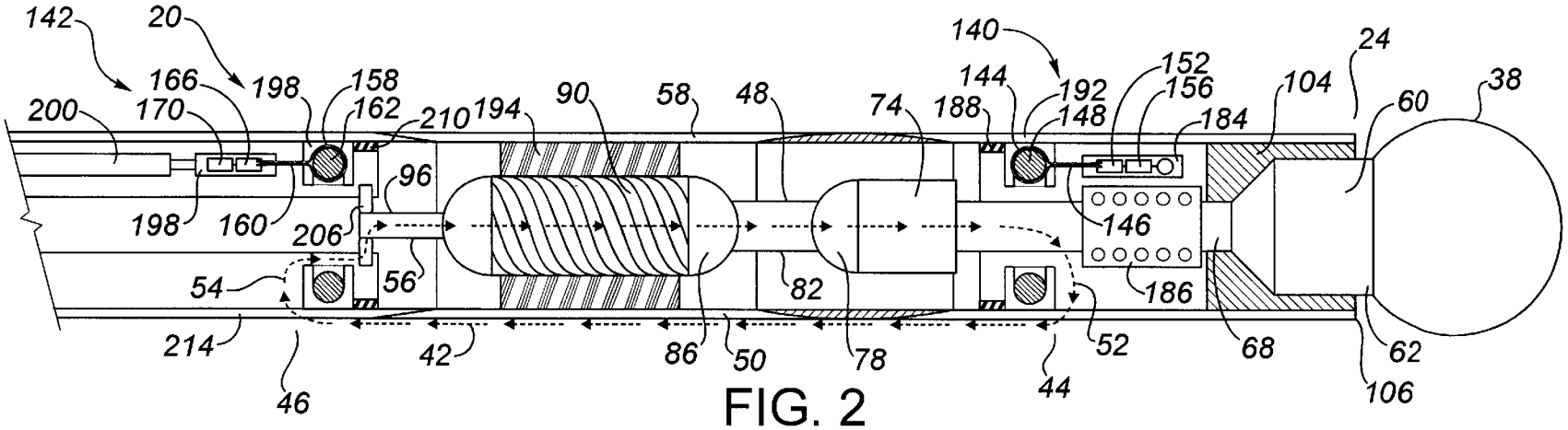
FIG. 2 is a further side schematic drawing of the preferred embodiment of the system, wherein the axial conducting loop is formed by a downhole motor drilling assembly.
Figure 3:
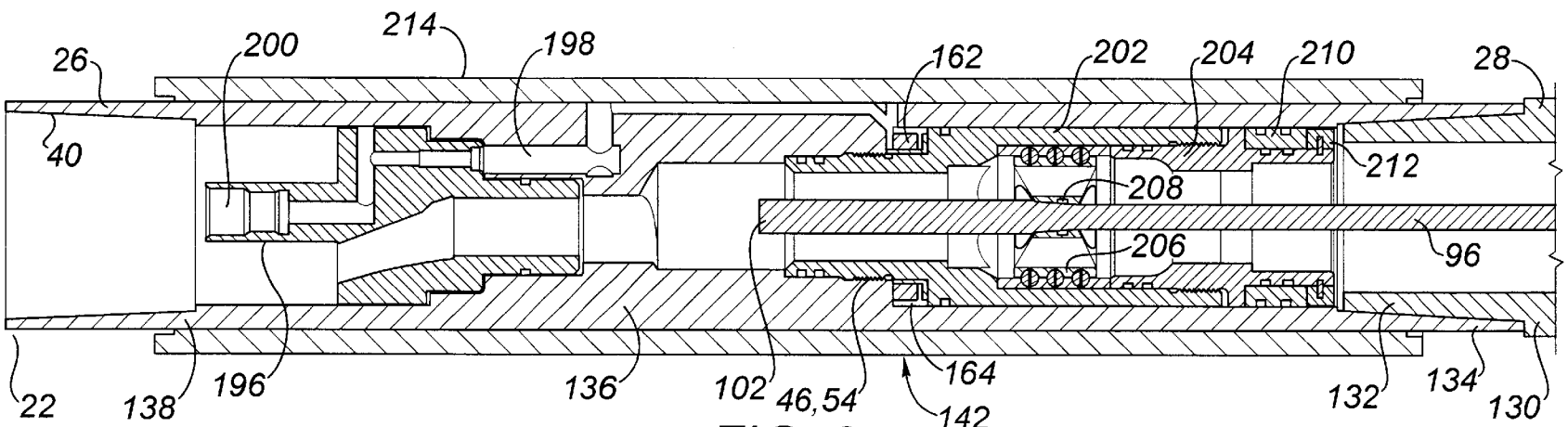
FIGS. 3, 4, 5, 6, 7 and 8 are longitudinal sectional views in sequence of the downhole motor drilling assembly of the preferred embodiment, FIGS. 4, 5, 6, 7 and 8 being lower continuations respectively of FIGS. 3, 4, 5, 6 and 7.
Figure 4:
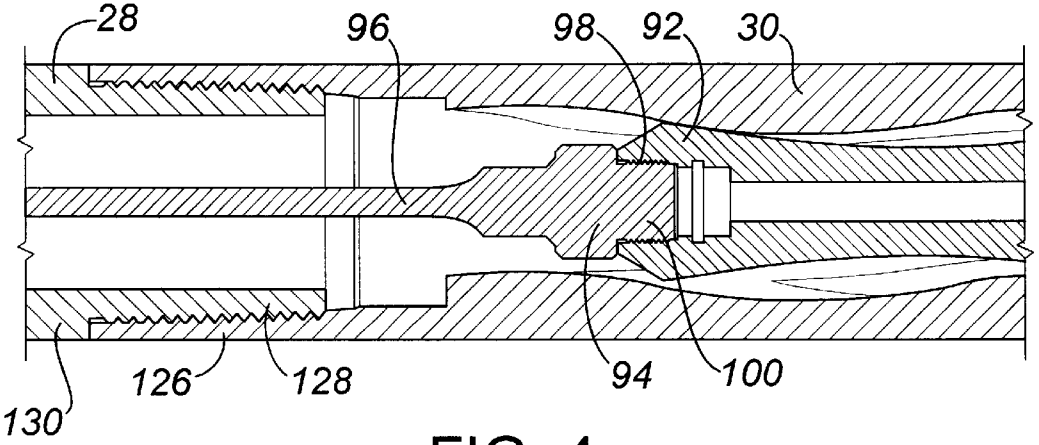
Figure 5:
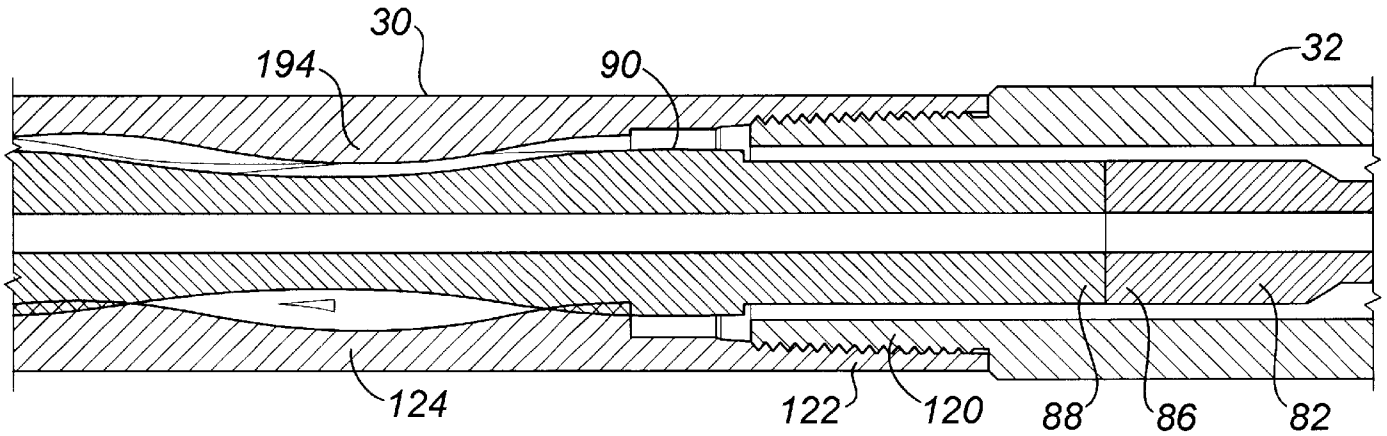
Figure 6:
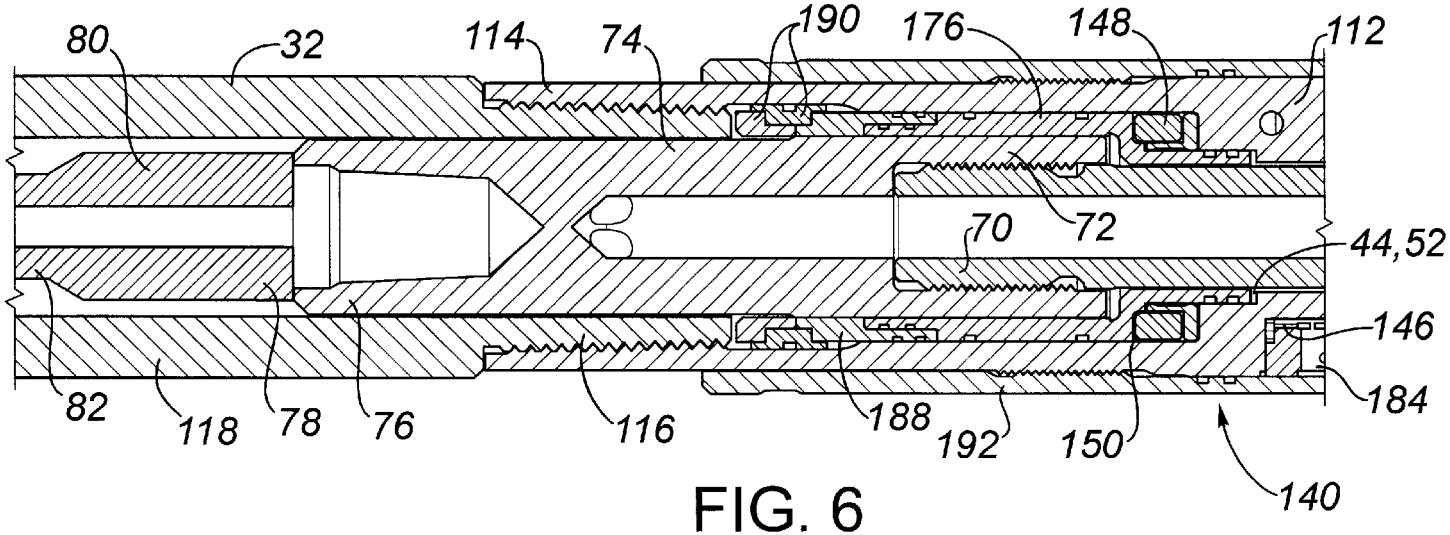
Figure 7:
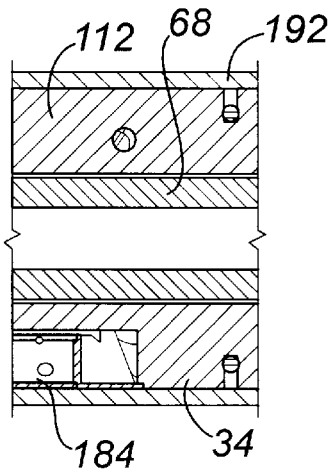
Figure 8:
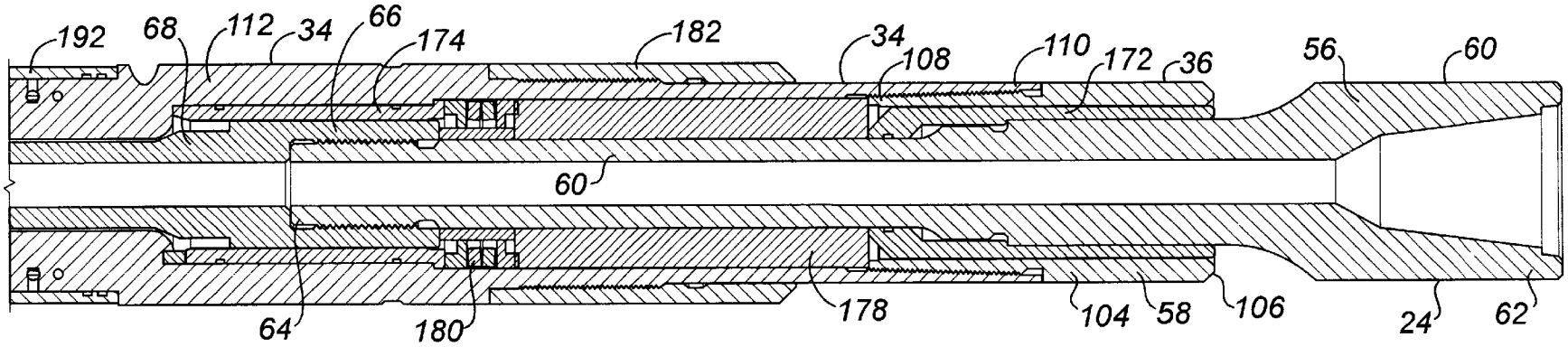
Figure 9:
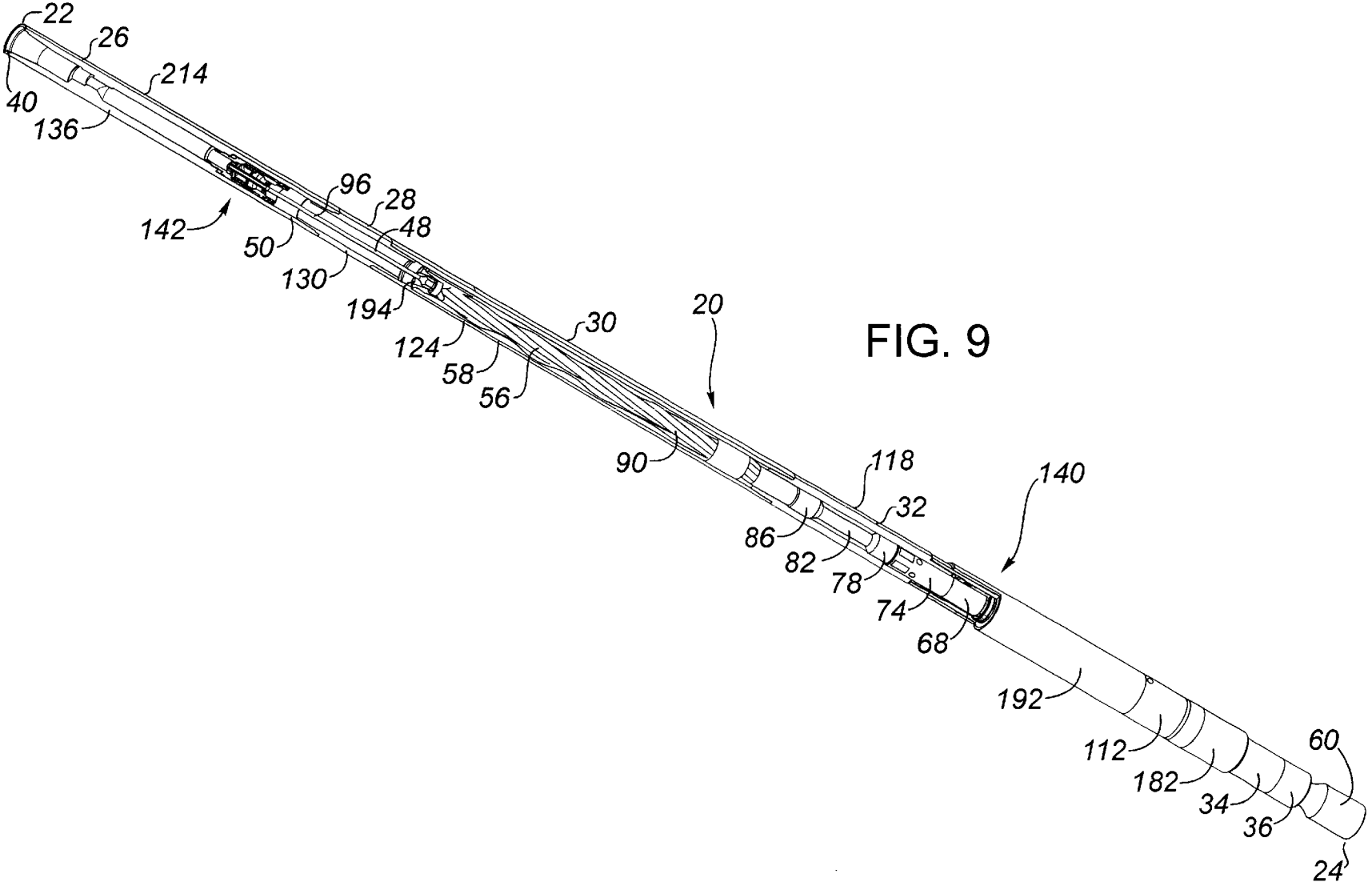
FIG. 9 is a side view of the complete assembled downhole motor drilling assembly detailed in FIGS. 3 through 8, wherein portions of a housing of the downhole motor drilling assembly have been cut away.
Figure 10:
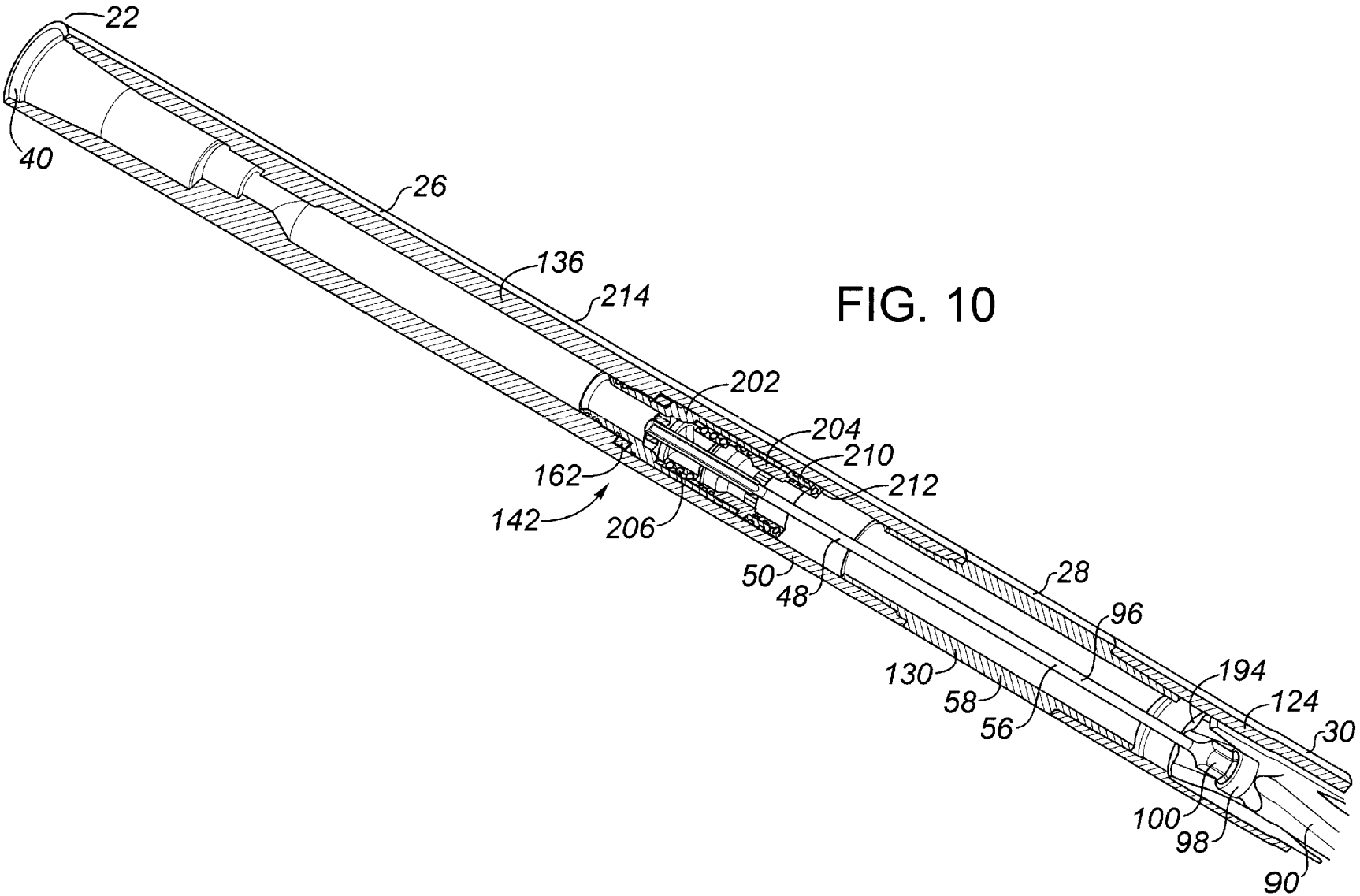
FIG. 10 is a side view of an upper end of the downhole motor drilling assembly shown in FIG. 9.
Figure 11:
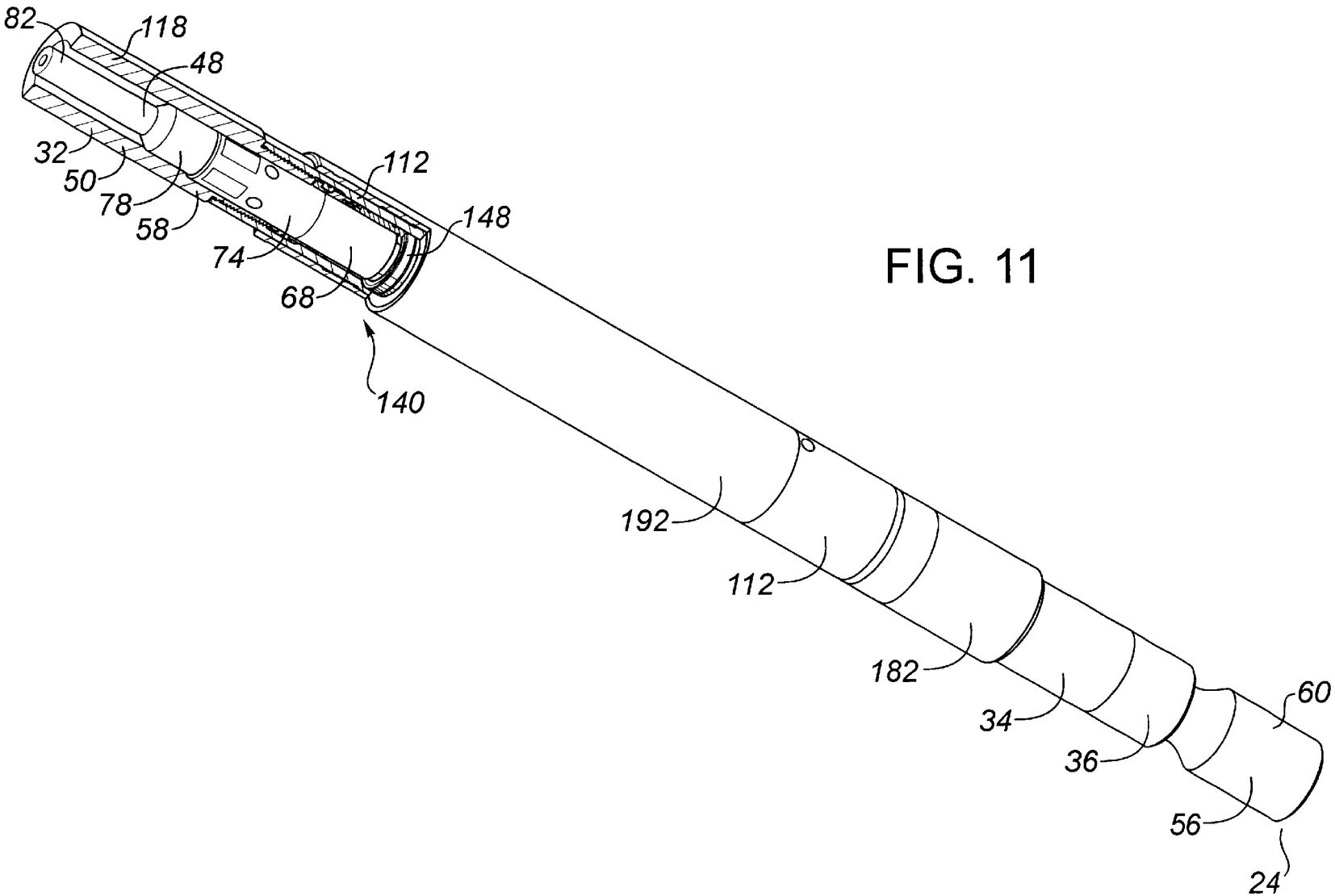
FIG. 11 is a side view of a lower end of the downhole motor drilling assembly shown in FIG. 9.

Referring to FIGS. 3 through 8, a downhole motor drilling assembly (20) according to a preferred embodiment of the present invention is shown. The drilling assembly (20) has an upper end (22) and a lower end (24) and in the preferred embodiment comprises a number of components connected together.

Beginning at the upper end (22) and moving toward the lower end (24), the drilling assembly (20) includes an receiver sub (26), a crossover sub (28), a power unit (30), a transmission unit (32), a bearing sub (34) and a lower bearing sub (36), all preferably connected end to end with threaded connections.

The drilling assembly (20) may also be made up of a single component or of a number of components other than as are described for the preferred embodiment of the invention. In addition, the components of the drilling assembly (20) may be connected together other than by using threaded connections. For example, some or all of the components may be connected by welding or with spline connections.

During drilling operations, a drilling bit (38) is located at the lower end (24) of the drilling assembly (20) and the upper end (22) of the drilling assembly (20) is connected to the remainder of the drill string (not shown) preferably by a threaded connection (40) which is part of the receiver sub (26).

The system of the invention includes an axial conducting loop (42) which extends between a first axial position (44) and a second axial position (46) in the drilling assembly (20). The axial positions (44,46) are interchangeable. In other words, the first axial position (44) may be located closer to the lower end (24) of the drilling assembly (20) than is the second axial position (46), or vice versa. In the preferred embodiment, the first axial position (44) is closer to the lower end (24) of the drilling assembly (20) than is the second axial position (46).

The axial conducting loop (42) may be formed by any component or components of the drill string. In the preferred embodiment, the axial conducting loop (42) is comprised of an inner axial conductor (48) and an outer axial conductor (50) which are conductively connected with each other at the first axial position (44) by a first conductive connection (52) and are conductively connected with each other at the second axial position (46) by a second conductive connection (54).

Preferably, the axial conducting loop (42) provides a continuous conductor loop having a resistance lower than the apparent resistance of the surrounding geological formation during drilling operations so that an axial electrical signal can be conducted around the axial conducting loop (42) without significant energy losses and without a significant amount of the axial electrical signal being diverted to the formation. In particular, the axial conducting loop preferably does not include a "gap" either in the axial conductors (48,50) or in the conductive connections (52,54) which would assist in diverting the axial electrical signal into the formation. Thus, in effect, the axial conducting loop (42) does not include the formation as an "in series" component of the current path for the axial electrical signal. The formation may however provide a parallel current path to the outer axial conductor (50). In this case, it has been found that there is no significant effect of the formation on the axial electrical signal regardless of whether the formation is highly conductive or highly resistive. Therefore, the conducting of the axial electrical signal around the axial conducting loop (42) is substantially formation independent.

Further, preferably, the axial conducting loop (42) provides a continuous conductor loop having a resistance lower than the resistance of the drilling mud or other drilling fluids passing through the drill string during drilling operations so that the axial electrical signal can be conducted around the axial conducting loop (42) without a significant amount of the axial electrical signal being diverted and lost to the drilling fluids. In particular, preferably, the axial conducting loop (42) is insulated at any point or location of exposure to the drilling fluids. As well, the axial electrical signal is preferably conducted around the axial conducting loop (42) without a significant amount of short circuiting between the axial positions (44,46). Thus, the axial conductor loop (42) is also preferably insulated between the inner and outer axial conductors (48,50).

In the preferred embodiment, the inner axial conductor (48) and the outer axial conductor (50) are comprised of components of the drilling assembly (20). In particular, in the preferred embodiment the inner axial conductor (48) is comprised of components of a drive train (56) for the drilling assembly (20) and the outer axial conductor (50) is comprised of a housing (58) for the drilling assembly (20).

Referring to FIGS. 3 through 8, the drive train (56) and the housing (58) of the drilling assembly (20) are made up of parts of the receiver sub (26), the crossover sub (28), the power unit (30), the transmission unit (32), the bearing sub (34) and the lower bearing sub (36). During drilling operations, the drive train (56) also includes the drilling bit (38). The drive train (56) is rotationally supported in the housing (58) as will be hereinafter described.

Beginning at the lower end (24) of the drilling assembly (20), the drive train (56) includes a drive shaft (60). The drive shaft (60) includes a distal end (62) which is adapted to be connected to the drilling bit (38). A proximal end (64) of the drive shaft (60) is threadably connected to a distal end (66) of a drive shaft extension (68). A proximal end (70) of the drive shaft extension (68) is threadably connected to a distal end (72) of a drive shaft cap (74). A proximal end (76) of the drive shaft cap (74) is threadably connected to a lower universal coupling (78). The lower universal coupling (78) is threadably connected to a distal end (80) of a transmission shaft (82). A proximal end (84) of the transmission shaft (82) is threadably connected to an upper universal coupling (86). The upper universal coupling (86) is threadably connected to a distal end (88) of a rotor (90). A proximal end (92) of the rotor (90) is connected to a distal end (94) of a flex rotor extension (96) by any connector or structure which can provide for the connection. As one example, a hexagonal box connection (98) at the proximal end (92) of the rotor may be connected to a hexagonal pin connection (100) at the distal end (94) of the flex rotor extension (96). As another example, a spring clutch may be used. The drive train (56) terminates at a proximal end (102) of the flex rotor extension (96).

Beginning at the lower end (24) of the drilling assembly (20), the housing (58) includes a lower bearing housing (104). The lower bearing housing (104) includes a distal end (106) from which the drive shaft (60) protrudes. A proximal end (108) of the lower bearing housing (104) is threadably connected to a distal end (110) of a bearing housing (112). A proximal end (114) of the bearing housing (112) is threadably connected to a distal end (116) of a transmission unit housing (118). A proximal end (120) of the transmission unit housing (118) is threadably connected to a distal end (122) of a power unit housing (124). A proximal end (126) of the power unit housing (124) is threadably connected to a distal end (128) of a crossover sub housing (130). A proximal end (132) of the crossover sub housing (130) is threadably connected to a distal end (134) of an receiver sub housing (136). A proximal end (138) of the receiver sub housing (136) includes the threaded connection (40) which facilitates connection of the drilling assembly (20) to the remainder of the drill string (not shown).

The axial conducting loop (42) may be made up of any portion of the drill string. In the preferred embodiment, the inner axial conductor (48) is made up of portions of the drive train (56), the outer axial conductor (50) is made up of portions of the housing (58), and the first and second axial positions (44,46) are locations in the drilling assembly (20) where the drive train (56) and the housing (58) are conductively connected by the conductive connections (52,54) such that an axial electrical signal being conducted in the drive train (56) can be transferred to the housing (58), and vice versa.

As a result, in the preferred embodiment, the drive train (56) and the housing (58) should be electrically insulated with respect to each other between the first and second axial positions (44,46) to avoid a short circuit which would prevent as substantial portion of the axial electrical signal from being communicated between the axial positions (44, 46).

Furthermore, the drive train (56) and the housing (58) should each provide a sufficient independent conducting path between the first and second axial positions (44,46) so that the axial electrical signal can be conducted between the axial positions (44,46) without significant energy loss and while minimizing the diversion of the axial electrical signal into the surrounding formation during drilling operations. To this end, the connections between components of the drive train (56) are preferably made with minimal resistance so that the inner axial conductor (48) between the axial positions (44,46) has a minimal overall resistance, and the connections between components of the housing (58) are preferably made with minimal resistance so that the outer axial conductor (50) between the axial positions (44,46) has a minimal overall resistance.

Similarly, the conductive connections (52,54) between the drive train (56) and the housing (58) at the first and second axial positions (44,46) should be sufficiently conductive so that the axial electrical signal can be transferred between the drive train (56) and the housing (58) without significant energy loss and while minimizing the diversion of the axial electrical signal into the surrounding formation during drilling operations. To this end, the conductive connections (52,54) are constructed to have a minimal resistance so that the axial conducting loop (42) has a minimal overall resistance.

In the preferred embodiment, the first axial position (44) and the first conductive connection (52) are located in the bearing sub (34) and the second axial position (46) and the second conductive connection (54) are located in the receiver sub (26). As a result, in the preferred embodiment, the axial conducting loop (42) is formed by the drilling assembly (20) which is part of the drill string during drilling operations and includes portions of the bearing sub (34), the transmission unit (32), the power unit (30) the crossover sub (28) and the receiver sub (26), with the result that the axial electrical signal is communicated between a location below the power unit (30) and a location above the power unit (30).

The invention is directed at communicating information between the axial positions (44,46) by conducting the axial electrical signal embodying the information through the axial conducting loop (42) between the axial positions (44,46).

The axial electrical signal may be comprised of any varying electrical signal, including unipolar alternating current (AC) signals, bipolar AC signals and varying direct current (DC) signals. The axial electrical signal may vary as a wave, pulse or in any other manner. The axial electrical signal is a modulated signal which embodies the information to be communicated. The axial electrical signal may be modulated in any manner, such as for example by using various techniques of amplitude modulation, frequency modulation and phase modulation. Pulse modulation, tone modulation and digital modulation techniques may also be used to modulate the axial electrical signal. The specific characteristics of the axial electrical signal will depend upon the characteristics of the transmitter electrical signal, as discussed below.

In the preferred embodiment, a transmitter (140) transmits the information to the axial conducting loop (42) by creating the modulated axial electrical signal embodying the information. Similarly, in the preferred embodiment, a receiver (142) receives the information from the axial conducting loop (42) by receiving the axial electrical signal embodying the information.

The transmitter (140) gathers the information to be communicated and then incorporates the information into a modulated transmitter electrical signal embodying the information. The transmitter (140) may be coupled to the axial conducting loop (42) either directly or indirectly, as discussed below.

The transmitter electrical signal may be any varying electrical signal which is capable of creating the axial electrical signal, including unipolar alternating current (AC) signals, bipolar AC signals and varying direct current (DC) signals. The transmitter electrical signal may vary as a wave, pulse or in any other manner. The transmitter electrical signal is a modulated signal which embodies the information to be communicated. The transmitter electrical signal may be modulated in any manner, such as for example by using various techniques of amplitude modulation, frequency modulation and phase modulation. Pulse modulation, tone modulation and digital modulation techniques may also be used to modulate the transmitter electrical signal.

The transmitter (140) may be directly coupled to the axial conducting loop (42) by establishing a direct electrical connection between the transmitter (140) and the axial conducting loop (42), such as by a hardwire connection, so that the transmitter electrical signal becomes the axial electrical signal when it enters the axial conducting loop (42). The transmitter (140) may be indirectly coupled to the axial conducting loop (42) by any method or device, such as for example inductive coupling, LC coupling, RC coupling, diode coupling, impedance coupling or transformer coupling, with the result that the conducting of the transmitter electrical signal in the transmitter (140) induces the axial electrical signal in the axial conducting loop (42). In the preferred embodiment, the transmitter (140) is indirectly coupled to the axial conducting loop (42) by transformer coupling techniques.

In the preferred embodiment, the transmitter (140) includes a transmitter coil (144) which comprises a transmitter conductor (146) wound on a transmitter core (148). The transmitter coil (144) is located in an electrically insulated annular transmitter space (150) between the drive train (56) and the housing (58) adjacent to the first axial position (44). The transmitter core (148) is preferably magnetically permeable and is preferably toroidally shaped so that it surrounds the drive train (56).

In the preferred embodiment the transmitter (140) further includes a transmitter processor (152) for receiving the information to be communicated and for generating the modulated transmitter electrical signal, a transmitter amplifier (154) for amplifying the transmitter electrical signal before it is sent to the transmitter coil (144), and a transmitter power supply (156) for providing electrical energy to the transmitter (140). The transmitter processor (152) may consist of one component or several components. The transmitter amplifier (154) may be part of the transmitter processor (152) or it may be separate therefrom.

The receiver (142) receives the information from the axial conducting loop (42) and then incorporates the information into a modulated receiver electrical signal embodying the information. The receiver (142) may be coupled to the axial conducting loop (42) either directly or indirectly.

The receiver electrical signal is a modulated signal which embodies the information being communicated. The receiver electrical signal may be modulated in any manner, such as for example by using various techniques of amplitude modulation, frequency modulation and phase modulation. Pulse modulation, tone modulation and digital modulation techniques may also be used to modulate the receiver electrical signal. The specific characteristics of the receiver electrical signal will depend upon the characteristics of the axial electrical signal.

The receiver (142) may be directly coupled to the axial conducting loop (42) by establishing a direct electrical connection between the receiver (142) and the axial conducting loop (42), such as by a hardwire connection, so that the axial electrical signal becomes the receiver electrical signal when it exits the axial conducting loop (42). The receiver (142) may be indirectly coupled to the axial conducting loop (42) by any method or device, such as for example inductive coupling, LC coupling, RC coupling, diode coupling, impedance coupling or transformer coupling, with the result that the conducting of the axial electrical signal in the axial conducting loop (42) induces the receiver electrical signal in the receiver (142). In the preferred embodiment, the receiver (142) is indirectly coupled to the axial conducting loop (42) by transformer coupling techniques.

In the preferred embodiment, the receiver (142) includes a receiver coil (158) which comprises a receiver conductor (160) wound on a receiver core (162). The receiver coil (158) is located in an electrically insulated annular receiver space (164) between the drive train (56) and the housing (58) adjacent to the second axial position (46). The receiver core (162) is preferably magnetically permeable and is preferably toroidally shaped so that it surrounds the drive train (56).

In the preferred embodiment the receiver (142) further includes a receiver processor (166) for processing the modulated receiver electrical signal, a receiver amplifier (168) for amplifying the receiver electrical signal after it is received from the axial conducting loop (42), and a receiver power supply (170) for providing electrical energy to the receiver (142). The receiver processor (166) may consist of one component or several components. The receiver amplifier (168) may be part of the receiver processor (160) or it may be separate therefrom.

In the preferred embodiment, the invention may be used to communicate information in both directions axially along the drill string. As a result, both a transmitter (140) and a receiver (142) may be located adjacent to each of the first axial position (44) and the second axial position (46). Alternatively, both the transmitter core (148) and the receiver core (162) may contain both transmitter conductor (146) windings and receiver conductor (160) windings, or as in the preferred embodiment, each of the transmitter (140) and the receiver (142) may function as a transceiver capable of both transmitting and receiving signals.

In the preferred embodiment, the system of the invention is incorporated into the drilling assembly (20). The components of a preferred embodiment of the drilling assembly (20) will thus be described in detail, beginning with the lower bearing sub (36) and moving toward the upper end (22) of the drilling assembly (20).

As previously described, the lower bearing sub (36) includes the lower bearing housing (104). The lower bearing housing (104) surrounds the drive shaft (60) and contains a lower radial bearing (172) in an annular space between the lower bearing housing (104) and the drive shaft (60). The lower radial bearing (172) is fixed to and rotates with the drive shaft (60) and functions to rotatably support the drive train (56) in the housing (58). The distal end (62) of the drive shaft (60) extends through the distal end (106) of the lower bearing housing (104) and the proximal end (64) of the drive shaft (60) extends through the proximal end (108) of the lower bearing housing (104).

In the preferred embodiment, the lower bearing sub (36) is connected to the bearing sub (34) in the manner as previously described. The bearing sub (34) includes the bearing housing (112). The bearing housing (112) contains a mid radial bearing (174) which is fixed to the bearing housing (112) and which functions to rotatably support the drive train (56) in the housing (58). The bearing housing (112) also contains an upper radial bearing (176) which is fixed to the bearing housing (112) and which functions to rotatably support the drive train (56) in the housing (58). Finally, the bearing housing (112) also contains a thrust bearing (178) which functions to axially support the drive train (56) in the housing (58). The thrust bearing (178) is contained along with spacers (180) in an annular space between the bearing housing (112) and the drive shaft (60).

The proximal end (64) of the drive shaft (60) extends into the distal end (110) of the bearing housing (112) where it connects with the distal end (66) of the drive shaft extension (68). The distal end (72) of the drive shaft cap (74) extends into the proximal end (114) of the bearing housing (112) where it connects with the proximal end (70) of the drive shaft extension (68). The drive shaft (60), drive shaft extension (68) and drive shaft cap (74) are connected in the manner as previously described so that the drive shaft extension (68) is fully contained in the bearing housing (112).

A kick pad (182) is threadably connected to the exterior of the bearing housing (112) adjacent to the distal end (110) of the bearing housing (112). The kick pad (182) provides protection for the drilling assembly (20) and functions as a fulcrum point during directional drilling.

The transmitter (140) is contained within the bearing housing (112). The transmitter coil (144) is contained in the electrically insulated annular transmitter space (150) between the bearing housing (112) and the drive shaft extension (68) adjacent to the upper radial bearing (176). The annular transmitter space (150) may be insulated with any material which will serve to isolate the transmitter coil (144) electrically from the surrounding parts of the bearing sub (34), thus preventing a short circuit between the transmitter conductor (146) and the bearing sub (34). In the preferred embodiment, the annular transmitter space (150) is insulated with one or a combination of air, foam or a potting material. The annular transmitter space (150) is also preferably completely enclosed so that the transmitter coil (144) is isolated and thus protected from the formation pressure during drilling operations.

The transmitter processor (152), the transmitter amplifier (154) and the transmitter power supply (156) are located in the bearing sub (34). A lower instrument cavity (184) is provided in the bearing housing (112) and one or more printed circuit board inserts (186) are provided in an annular space between the drive shaft extension (68) and the bearing housing (112) to contain these components. The transmitter conductor (146) feeds into the lower instrument cavity (184), which is also electrically connected with the printed circuit board inserts (186). One or more sensors (not shown) are electrically connected with either or both of the lower instrument cavity (184) and the printed circuit board inserts (186) in order to provide the transmitter (140) with information for communication to the receiver (142) via the axial conducting loop (42).

In the preferred embodiment, the first axial position (44) is defined by the first conductive connection (52), which is a location of electrically conductive interface between the bearing housing (112) and the drive shaft extension (68) and which begins at a point toward the lower end (24) of the drilling assembly (20) immediately adjacent to the lower end of the upper radial bearing (176). At the first conductive connection (52), the axial electrical signal is able to move between the bearing housing (112) and the drive shaft extension (68) without encountering significant resistance. The conductivity of the first conductive connection (52) is enhanced by the thrust bearing (178) described above, which assists in maintaining the contact between the adjacent surfaces of the bearing housing (112) and the drive shaft extension (68).

In the preferred embodiment, the purpose of the transmitter (140) is to induce from the transmitter electrical signal the axial electrical signal in the axial conducting loop (42). As a result, preferably the axial conducting loop (42) extends through the transmitter coil (144) in order to maximize the exposure of the axial conducting loop (42) to the varying magnetic flux created by the transmitter electrical signal. The transmitter coil (144) may, however, be positioned at any location relative to the axial conducting loop (42) which results in exposure of the axial conducting loop (42) to the varying magnetic flux.

The preferred result is achieved in the preferred embodiment by providing electrical insulation between the drive train (56) and the housing (58) from the proximal end (114) of the bearing housing (112) to the first axial position (44). In particular, insulation is provided along the interface between the upper radial bearing (176) and the bearing housing (112), and specifically, along the portion of the interface located above the transmitter (140). Any manner or type of insulation may be used. However, preferably, the insulation is comprised of a nonconductive coating applied to one or both of the inner surface of the bearing housing (112) and the outer surface of the upper radial bearing (176) at the interface. Any non-conductive coating may be used. For instance, the non-conductive coating may be comprised of either an epoxy coating or a Teflon (trademark) coating. In the preferred embodiment, the upper radial bearing (176) is coated with an epoxy coating, and in particular, a relatively high strength epoxy coating.

Further, an electrically insulated seal (188) is provided adjacent to the upper end of the upper radial bearing (176) between the drive shaft cap (74) and the bearing housing (112). The electrically insulated seal (188) is maintained in position with a bearing spacer and retainer assembly (190), preferably electrically insulated. The electrically insulated seal (188) is preferably comprised of a non-conductive fibreglass (PEEK). The electrically insulated seal (188) assists in providing an atmospheric cavity for the transmitter (140) without causing any short circuiting in the axial conducting loop (42) between the first and second axial positions (44,46).

As a result of the insulated interface, as described above, the drive train (56) and the housing (58) are electrically insulated relative to each other from the proximal end (114) of the bearing housing (112) to the first axial position (44).

The bearing housing (112) may be surrounded by a lower pressure housing (192) which is threadably connected to the outer surface of the bearing housing (112) in the vicinity of the transmitter (140) and which assists in isolating the transmitter (140) from pressures exerted on the drilling assembly (20) by the surrounding wellbore during drilling operations.

In the preferred embodiment, the bearing sub (34) is connected to the transmission unit (32) in the manner as previously described. The proximal end (76) of the drive shaft cap (74) extends into the distal end (116) of the transmission unit housing (118) and the distal end (88) of the rotor (90) extends into the proximal end (120) of the transmission unit housing (118). The rotor (90) and the drive shaft cap (74) are connected to each other in the transmission unit housing (118) by the transmission shaft (82) and the upper and lower universal couplings (86,78) in the manner as previously described.

The transmission unit (32) forms part of the axial conducting loop (42). The transmission unit housing (118) forms a portion of the outer axial conductor (50). The transmission unit housing (118) may be a straight housing, a bent housing or an adjustable bent housing. The drive shaft cap (74), the lower universal coupling (78), the transmission shaft (82), the upper universal coupling (86) and the rotor (90) form a portion of the inner axial conductor (48). In order to minimize the resistance of the inner axial conductor (48), the connection between the drive shaft cap (74), the lower universal coupling (78) and the transmission shaft (82) and the connection between the rotor (90), the upper universal coupling (86) and the transmission shaft (82) are preferably lubricated with a conductive grease.

The transmission unit housing (118) is electrically isolated from the drive train (56) components which pass through the transmission unit housing (118) in order to prevent a short circuit of the axial electrical signal between the axial positions (44,46). This electrical isolation is achieved in the preferred embodiment by providing electrical insulation between the transmission unit housing (118) and the drive train (56) components passing therethrough. Any manner or type of insulation may be used. Preferably, a fluid gap is provided between the inner surface of the transmission unit housing (118) and the adjacent outer surfaces of the transmission shaft (82) and the drive shaft cap (74). It has been found that a fluid gap of greater than or equal to about 0.06 inches provides sufficient insulation between the adjacent surfaces to prevent any significant short circuiting. Alternatively, the insulation, or a portion thereof, may be comprised of a non-conductive coating applied to one or both of the adjacent surfaces. Any non-conductive coating may be used. For instance, the non-conductive coating may be comprised of either an epoxy coating or a Teflon (trademark) coating. A non-conductive coating may be required where the drilling operation involves highly conductive drilling fluids.

In the preferred embodiment, the transmission unit (32) is connected to the power unit (30) in the manner as previously described. The distal end (88) of the rotor (90) extends into the proximal end (120) of the transmission unit housing (118) and the distal end (94) of the flex rotor extension (96) extends into the proximal end (126) of the power unit housing (124). The rotor (90) and the flex rotor extension (96) are connected to each other in the power unit housing (124) in the manner as previously described.

The power unit (30) forms part of the axial conducting loop (42). The power unit housing (124) forms a portion of the outer axial conductor (50). The rotor (90) and the flex rotor extension (96) form a portion of the inner axial conductor (48). In the preferred embodiment the power unit (30) is comprised of a positive displacement motor (PDM). The power unit (30) may, however, be comprised of other types of motor, such as for example a turbine type motor.

In the preferred embodiment where the power unit (30) is comprised of a positive displacement motor, the power unit housing (124) contains a stator (194). The stator (194) comprises an elastomeric helical sleeve which is fixed to the interior surface of the power unit housing (124) and surrounds the rotor (90). The rotor (90) is also helical in shape and is rotated in the stator (194) by pressure exerted on the rotor (90) by drilling fluids which are passed through the interior of the drilling assembly (20) during drilling operations.

The power unit housing (124) is electrically isolated from the drive train (56) components which pass through the power unit housing (124) in order to prevent a short circuit of the axial electrical signal between the axial positions (44,46). Electrical isolation of the rotor (90) relative to the power unit housing (124) in the vicinity of the stator (194) is achieved by constructing the stator (194) from an electrically insulating elastomeric material. Electrical isolation of the rotor (90) relative to the power unit housing (124) other than in the vicinity of the stator (194) is achieved by providing electrical insulation between the rotor (90) and the power unit housing (124). Again, any manner or type of insulation may be used. Preferably, a fluid gap, as described above, is provided between the outer surface of the rotor (90) and the inner surface of the power unit housing (124). Alternatively, the insulation, or a portion thereof, may be comprised of a non-conductive coating, as described above, applied to one or both of the adjacent surfaces. Again, a non-conductive coating may be required where the drilling operation involves highly conductive drilling fluids.

In the preferred embodiment, the crossover sub (28) is connected to the power unit (30) in the manner as previously described. The flex rotor extension (96) extends through the entire length of the crossover sub (28). The purpose of the crossover sub (28) is to adapt the threaded connection at the proximal end (126) of the power unit housing (124) to the threaded connection at the distal end (134) of the receiver sub housing (136).

The crossover sub (28) forms part of the axial conducting loop (42). The crossover sub housing (130) forms a portion of the outer axial conductor (50). The flex rotor extension (96) forms a portion of the inner axial conductor (48).

The crossover sub housing (130) is electrically isolated from the drive train (56) components which pass through the crossover sub housing (130) in order to prevent a short circuit of the axial electrical signal between the axial positions (44,46). In the preferred embodiment this electrical isolation is achieved by coating the flex rotor extension (96) with an electrically insulating material. The coating may be comprised of any insulating material, such as epoxy or Teflon (trademark). However, in the preferred embodiment, the coating is comprised of a silica impregnated Teflon (trademark) coating. Alternatively, where the drilling fluid is not highly conductive, the electrical isolation may be achieved by a fluid gap, as described above.

In the preferred embodiment, the receiver sub (26) is connected to the crossover sub (28) in the manner as previously described. The proximal end (102) of the flex rotor extension (96) extends into the distal end (134) of the receiver sub housing (136) and terminates within the receiver sub (26).

The distal end (134) of the receiver sub housing (136) contains the upper portion of the axial conducting loop (42), while the proximal end (138) of the receiver sub housing (136) provides an upper electronics hanger (196).

The receiver (142) is contained within the receiver sub housing (136). The receiver coil (158) is contained in the electrically insulated annular receiver space (164) between the receiver sub housing (136) and the flex rotor extension (96). The annular receiver space (164) may be insulated with any material which will serve to isolate the receiver coil (158) electrically from the surrounding parts of the receiver sub (26), thus preventing a short circuit between the receiver conductor (160) and the receiver sub (34). In the preferred embodiment, the annular receiver space (164) is insulated with one or a combination of air, foam or a potting material. The annular receiver space (164) is also preferably completely enclosed so that the receiver coil (158) is isolated and thus protected from the formation pressure during drilling operations.

The receiver processor (166), the receiver amplifier (168) and the receiver power supply (170) are located in the receiver sub (26) in the upper electronics hanger (196). An upper instrument cavity (198) is provided in the upper electronics hanger (196) to contain these components. The receiver conductor (160) feeds into the upper instrument cavity (198). One or more sensors (not shown) may be electrically connected with the upper instrument cavity (198) in order to provide the receiver (142) with information for communication to the transmitter (140) via the axial conducting loop (42). Alternately, the receiver processor (166), the receiver amplifier (168) and the receiver power supply (170) may be located or positioned in a sonde (not shown) above the upper electronics hanger (196).

In addition, the receiver (142) is capable of communication with a surface communication system (not shown) so that information received by the receiver from the transmitter (140) via the axial conducting loop (42) can be communicated from the receiver (142) to the surface communication system (not shown) and so that information received by the receiver (142) from the surface communication system (not shown) can be communicated to the transmitter (140) via the axial conducting loop (42). A surface communications uplink cavity (200) is provided in the upper electronics hanger (196) to house components of the surface communications system (not shown) which interface with the receiver (142).

The surface communication system (not shown) may be comprised of any system or combination of systems which is capable of communicating with the receiver (142). In the preferred embodiment, the surface communication system (not shown) is a mud (drilling fluid) pressure pulse system, an acoustic system, a hard wired system or an electromagnetic system.

In the preferred embodiment, the purpose of the receiver (142) is to induce from the axial electrical signal the receiver electrical signal in the receiver conductor (160). As a result, preferably the axial conducting loop (42) extends through the receiver coil (158) in order to maximize the exposure of the receiver coil (158) to the varying magnetic flux created by the axial electrical signal in the axial conducting loop (42). The receiver coil (158) may, however, be positioned at any location relative to the axial conducting loop (42) which results in exposure of the receiver coil (158) to the varying magnetic flux.

The preferred result is achieved in the preferred embodiment by the configuration of the components of the receiver sub (26). The proximal end (102) of the flex rotor extension (96) is supported in the receiver sub housing (136) by a slip ring bearing assembly. The slip ring bearing assembly comprises a slip ring bearing insert (202) which surrounds the flex rotor extension (96) adjacent to the proximal end (102) of the flex rotor extension (96) and a slip ring bearing retainer (204) which retains the slip ring bearing insert (202) in place.

The slip ring bearing insert (202) forms part of the second conductive connection (54) and houses a slip ring (206). The slip ring (206) maintains contact between the flex rotor extension (96) and the slip ring bearing insert (202) by rotatably cushioning the flex rotor extension (96) from vibration caused by rotation of drive train (56) components. The slip ring (206) is maintained snugly in position around the flex rotor extension (96) by a coil spring (208) which biases the slip ring (206) radially outwards away from the flex rotor extension (96) and enables the slip ring (206) to adapt to radial movement of the flex rotor extension (96) caused by vibration of drive train (56) components.

The inner axial conductor (48) of the axial conducting loop (42) includes the slip ring (206) and the slip ring bearing insert (202). As a result, the springs (208) assist in maintaining constant contact between the slip ring (206) and the flex rotor extension (96) so that the axial electrical signal can be conducted between the axial positions (44,46) without significant energy loss.

In the preferred embodiment, the annular receiver space (164) is defined by the slip ring bearing insert (202) and the second axial position (46) is defined by the second conductive connection (54), which is a location of electrically conductive interface between the slip ring bearing insert (202) and the receiver sub housing (136). At the second conductive connection (54), the axial electrical signal is able to move between the slip ring bearing insert (202) and the receiver sub housing (136) without encountering significant resistance. In the preferred embodiment, the axial electrical signal is therefore conducted through the flex rotor extension (96), from the flex rotor extension (96) to the slip ring (206), from the slip ring (206) to the slip ring bearing insert (202) and from the slip ring bearing insert (202) to the receiver sub housing (136), with the result that the axial electrical signal passes through the interior of the receiver coil (158). The conductivity of the second conductive connection (54) is enhanced by the presence of a threaded connection between the slip ring bearing insert (202) and the receiver sub housing (136).

A short circuit of the axial electrical signal in the receiver sub (26) is prevented by providing electrical insulation between the flex rotor extension (96) and the receiver sub housing (136) between the distal end (134) of the receiver sub housing (136) and the location of the slip ring (206). In particular, electrical insulation is provided along the interface between the slip ring bearing retainer (204) and the receiver sub housing (136), along the interface between the slip ring bearing insert (202) and the receiver sub housing (136) up to the location of the slip ring (206), and an electrically insulated pressure seal (210) is provided in an annular space between the slip ring bearing retainer (204) and the receiver sub housing (136), which insulated pressure seal (210) is maintained in position with an electrically insulated pressure seal retainer (212). Any manner or type of electrical insulation may be provided along the interface. However, preferably, the insulation is comprised of a non-conductive coating applied to one or both of the inner surface of the receiver sub housing (136) and the outer surfaces of the slip ring bearing retainer (204) and slip ring bearing insert (202). Any non-conductive coating may be used. For instance, the non-conductive coating may be comprised of either an epoxy coating or a Teflon (trademark) coating. In the preferred embodiment, the coating is comprised of a high temperature epoxy.

The receiver sub housing (136) may be surrounded by an upper pressure housing (214) which is threadably connected to the outer surface of the receiver sub housing (136) in the vicinity of the receiver (142) and which assists in isolating the receiver (142) from pressures exerted on the drilling assembly (20) by the surrounding wellbore during drilling operations.

The system of the present invention is therefore directed at providing an axial conducting loop (42) with minimal resistance which extends between the axial positions (44,46) and which can conduct the axial electrical signal between the axial positions (44,46) without significant energy losses due to short or open circuits or diverting of the axial electrical signal either to the formation or to the drilling mud or other fluids passing through the drill string during drilling operations.

In the preferred embodiment, the axial electrical signal is provided to the axial conducting loop (42) by the transmitter (140) which is electrically coupled to the axial conducting loop (42) by transformer coupling techniques, and the axial electrical signal is received by the receiver (142) which is also electrically coupled to the axial conducting loop (42) using transformer coupling techniques. In the preferred embodiment, the transmitter (140) and the receiver (140) are both transceivers and are constructed identically, with the exception of their specific mechanical configuration.

In the preferred embodiment, the axial conducting loop (42) is comprised of the inner axial conductor (48), the outer axial conductor (50), the first conductive connection (52) and the second conductive connection (54). The inner axial conductor (48) and the outer axial conductor (50) are electrically insulated relative to each other between the conductive connections (52,54) to minimize short circuits. In addition, the components making up the axial conductors (48,50) are connected so as to minimize resistance between the components, also to minimize diverting of the axial electrical signal into the formation or the drilling fluids passing therethrough and to minimize energy losses. Finally, the conductive connections are also configured to minimize their resistance, again to minimize diverting of the axial electrical signal into the formation or the drilling fluids and to minimize energy losses.

The invention also includes a method for communicating information along a drill string between the first axial position (44) and the second axial position (46). Preferably the method is performed using the system as previously described.

In a preferred embodiment of the method of the invention, information may be communicated in either direction between the transmitter (140) and the receiver (142) and both the transmitter (140) and the receiver (142) function as transceivers. The receiver (142) is therefore capable of providing a transmitter electrical signal and the transmitter (140) is capable of providing a receiver electrical signal depending upon the direction in which the information is being communicated. As a result, in the discussion of the method that follows, "transmitter electrical signal" is an electrical signal which is conducted by either the transmitter (140) or the receiver (142) when functioning as a transmitter, and "receiver electrical signal" is an electrical signal which is conducted by either the transmitter (140) or the receiver (142) when functioning as a receiver.

As previously described, the axial electrical signal may be any varying electrical signal which can be modulated to embody the information. In the preferred embodiment, the axial electrical signal is induced in the axial conducting loop (42) by the transmitter electrical signal.

Preferably, the axial electrical signal is induced in the axial conducting loop (42) with the assistance of a "flyback effect" created in the transmitter coil (144). This flyback effect is achievable where the transmitter electrical signal is a square pulse signal which can produce a theoretically infinite rate of change of magnetic flux between pulses. The flyback effect creates a flyback voltage which is amplified in comparison with the voltage of the transmitter electrical signal.

In the preferred embodiment of the method of the invention, the magnitude of the flyback voltage is typically approximately 5 times the voltage of the transmitter electrical signal where a unipolar square pulse signal is used as the varying electrical signal for the transmitter electrical signal. The magnitude of the flyback effect will, however, depend upon the specific characteristics of the transmitter electrical signal and the transmitter coil (144).

Both unipolar and bipolar varying electrical signals can produce the flyback effect. However, the use of a unipolar signal tends to simplify the creation and application of the flyback effect. For example, with a unipolar varying electrical signal as the transmitter electrical signal, transformer coupling produces a bipolar axial electrical signal and a bipolar receiver electrical signal. Due to the change in current direction, the receiver (142) tends to develop a zero bias or offset.

As a result, in the preferred embodiment the transmitter electrical signal is a unipolar square pulse signal so that the flyback effect can be created in a relatively simple manner. A unipolar signal may, however, create a hysteresis effect in the cores (148,162) and should thus be used with care to avoid permanently magnetizing the cores (148,162).

Although any frequency of varying electrical signal may be used in the performance of the method, preferably the transmitter electrical signal varies at a carrier frequency of between about 1 hertz and about 2 megahertz. More preferably the transmitter electrical signal varies at a carrier frequency of between about 10 kilohertz and about 2 megahertz. In the preferred embodiment the transmitter electrical signal varies at a carrier frequency of about 400 kilohertz.

The transmitter electrical signal may be modulated in any manner to embody the information. In the preferred embodiment, the transmitter electrical signal is a frequency modulated (FM) signal.

The cores (148,162) of the coils (144,158) may be any size or shape and may be wound with any number of windings. The cores (148,162) and the coils (144,158) may be the same or they may be different. Preferably, however, the transmitter coil (144) and the receiver coil (158) are wound with the transmitter conductor (146) and the receiver conductor (160) respectively to achieve a resonant frequency which is compatible with the wavelength (and thus the frequency) of the transmitter electrical signal.

In the preferred embodiment, the transmitter coil (144) and the receiver coil (158) are wound identically, but the specific number of windings on the cores (148,162) will depend upon the size, shape and electromagnetic characteristics of the cores (148,162) and upon the specific desired operating parameters of the transmitter (140), the receiver (142) and the axial conducting loop (42). As a result, it is not necessary that the coils (144,158) have the same number of windings, particularly if the cores (148,162) have different sizes or different electromagnetic characteristics.

In the preferred embodiment, the cores (148,162) of the coils (144,158) are approximately square in cross section and have a cross sectional area of about 400 square millimetres. The outer diameter of the cores (148,162) is about 100 millimetres and the inner diameter of the cores (148, 162) is about 75 millimetres. The coils (144,158) are each wound with the necessary number of windings required to achieve the desired resonant frequency, as discussed above and as measured by an impedance meter. However, in the preferred embodiment, each of the coils (144,158) has about 125 windings.

Although any voltage may be used in the invention, the voltage of the transmitter electrical signal is limited by the choice of components and the power consumption. It is preferable to minimize power consumption and to minimize the size of the necessary power supplies (156,170). Preferably, the voltage of the transmitter electrical signal is between about 2 volts (peak to peak) and about 10 volts (peak to peak). "Peak to peak" refers to the amount of variation of the voltage of the electrical signal. In the preferred embodiment, the voltage of the transmitter electrical signal is about 5 volts (peak to peak). As stated, the flyback voltage is typically found to be approximately 5 times the voltage of the transmitter electrical signal. Thus, in the preferred embodiment, the flyback voltage is approximately 25 volts (peak to peak).

Although any amount of electrical power may be used in the invention, the power output of the transmitter electrical signal is preferably minimized in order to minimize the power requirements of the system and thus the size of the transmitter power supply (156).

In the preferred embodiment, each of the transmitter (140) and the receiver (142) are also capable of gathering information for communication between the axial positions (44, 46). As a result, in the preferred embodiment the transmitter power supply (156) serves to energize the transmitter (140) and any sensors which provide information to the transmitter (140) for communication to the receiver (142), and the receiver power supply (170) serves to energize the receiver (142) and any sensors which provide information to the receiver (142) for communication to the transmitter (140).

In the preferred embodiment, the transmitter coil (144) is adjacent to the first axial position (44) and the receiver coil (158) is adjacent to the second axial position (46). As a result, in the preferred embodiment the transmitter (140) communicates information from below the power unit (30) to above the power unit (30) and the receiver (142) communicates that information to a surface communication system (not shown) such as a MWD mud pulse telemetry. In addition, where the transmitter (140) and the receiver (142) each are comprised of a transceiver, information may be communicated downhole from above the power unit (30) to below the power unit (30). The transmitter power supply (156) may therefore also serve to energize any components of the drill string which must react to the information communicated downhole and the receiver power supply (170) may also serve to energize components of the surface communications system (not shown) which must continue the communication to the surface of information received by the receiver (142) from the transmitter (140).

Preferably, the transmitter power supply (156) energizes the transmitter (140) and all of its associated sensors and other components, while the receiver power supply (170) energizes the receiver (142) and all of its associated sensors and other components. However, a separate power supply (not shown) may be provided for energizing any of the sensors or components associated with one or both of the transmitter (140) and the receiver (142).

The transmitter power supply (156) may be located in the drill string or it may be located at the surface and be electrically connected to the transmitter (140) from the surface. In the preferred embodiment, the transmitter power supply (156) is located as previously described in the housing (58) of the drilling assembly (20). In the preferred embodiment, the transmitter power supply (156) includes one or more DC batteries contained within the lower instrument cavity (184) which may be connected in series or parallel to achieve a desired voltage, current and power consumption for a transmitter electrical signal generated by the transmitter (140) and to energize any other functions which must be performed by the transmitter (140).

The receiver power supply (170) may be located in the drill string or it may be located at the surface and be electrically connected to the receiver (142) from the surface. In the preferred embodiment, the receiver power supply (170) is located as previously described in the housing (58) of the drilling assembly (20). In the preferred embodiment, the receiver power supply (170) includes one or more DC batteries contained within the upper instrument cavity (198) which may be connected in series or parallel to achieve a desired voltage, current and power consumption for a receiver electrical signal generated by the receiver (142) and to energize any other functions which must be performed by the receiver (142).

The procedure for communicating information from the transmitter (140) to the receiver (142) during drilling operations according to a preferred embodiment of the invention is as follows.

First, information is obtained during drilling operations by sensors located on the drill string below the power unit (30). This information may consist of data about the drilling bit (38), the borehole in the vicinity of the drilling bit (38), or about the formation in the vicinity of the drilling bit (38). This information is gathered by the transmitter processor (152). An oscillator in the transmitter processor (152) creates a varying carrier signal at a frequency of about 400 kilohertz which carrier signal is modulated by the transmitter processor (152) using frequency modulation techniques to embody the information therein to form the transmitter electrical signal.

Second, the transmitter electrical signal is amplified by the transmitter amplifier (154) and the amplified transmitter electrical signal is conducted through the transmitter coil (144) via the transmitter conductor (146) so that the transmitter electrical signal passing through the transmitter coil has a voltage of about 5 volts (peak to peak) and a power output of less than about 50 milliwatts.

Third, the transmitter electrical signal induces in the axial conducting loop (42) the conduct of the axial electrical signal embodying the information. At a frequency of about 400 kilohertz, the preferred voltage of the transmitter electrical signal of 5 volts (peak to peak) produces a flyback voltage of about 25 volts (peak to peak). Further, in the preferred embodiment, where the flyback voltage is about 25 volts (peak to peak) and the transmitter (140) has about 125 windings, an axial electrical signal is induced in the axial conducting loop (42) having a stepped down voltage but a stepped up current.

Fourth, the conduct of the axial electrical signal in the axial conducting loop (42) induces in the receiver coil (158) the conduct of the receiver electrical signal embodying the information. In the preferred embodiment, where the axial electrical signal has a voltage of about 0.2 volts (peak to peak) and the receiver (142) has about 125 windings, a receiver electrical signal is induced in the receiver (142) having a stepped up voltage of about 25 volts (peak to peak). This value is however dampened and attenuated by resistance in the axial conducting loop (42) and any short circuiting of the axial electrical signal across the inner and outer axial conductors (48,50).

Fifth, the receiver electrical signal is amplified by the receiver amplifier (168) and the amplified receiver electrical signal is passed through the receiver processor (166) for processing, where the receiver electrical signal is demodulated to obtain the information from the receiver electrical signal.

Sixth, the information is forwarded to a surface communications uplink processor (not shown) located in the surface communications uplink cavity (200) which prepares the information for communication to the surface via the surface communications system (not shown). Other information may also be sent directly to the surface communications uplink processor (not shown) by sensors which are located above the power unit (30) and which are either associated with the receiver (142) or are independent from the receiver (142).

Seventh, the information obtained from the receiver electrical signal and any other information obtained from other sensors is communicated to the surface via the surface communications system (not shown).

The procedure for communicating information from the receiver (142) to the transmitter (140) during drilling operations according to the preferred embodiment of the invention is essentially the reverse of the procedure for communicating information from the transmitter (140) to the receiver (142), with the result that the transmitter (140) functions as a receiver and the receiver (142) functions as a transmitter.

In this reverse procedure, the information which is communicated between the axial positions (44,46) is obtained either from sensors located above the power unit (30) or from the surface via the surface communications system (not shown) and is typically communicated to the transmitter (140) in order to achieve some variation in the drilling operation.

The system and method of the invention potentially provides several important improvements over prior art systems and methods.

First, the invention does not utilize the formation either for a current path or for electromagnetic wave propagation. Instead, the axial electrical signal is conducted through the axial conducting loop (42) which is made up entirely of the drill string.

This distinction enables the invention to be used over a broader range and to a higher limit of carrier frequencies, since it is not necessary to match the carrier frequency to the resistance of the formation. For example, although the carrier frequency of the transmitter electrical signal in the preferred embodiment is about 400 kilohertz, there is no theoretical minimum or maximum carrier frequency and the carrier frequency is limited only by the ability to embody the information in the carrier signal and the ability to conduct the carrier signal through the axial conducting loop. The maximum carrier frequency may also be limited by the desire to minimize power consumption as in the preferred embodiment.

This distinction may also result in a reduced power demand for the system in comparison with prior art systems, since the axial electrical signal need only be strong enough to be conducted through the axial conducting loop (42) and not through the formation to the surface. In the preferred embodiment, the transmitter electrical signal is about 5 volts (peak to peak) and the power output of the transmitter electrical signal has been found to be less than about 50 milliwatts during transmission of the transmitter electrical signal, which means that the requirements of the transmitter power supply (156) are potentially less than with prior art systems.

Second, the invention does not require the use of electrical wiring throughout the drill string, since the axial conducting loop (42) is made up of drill string components.

This distinction may reduce fabrication, assembly, maintenance and repair costs in comparison with other "hard-wired systems", since the axial conducting loop (42) is completely integrated with the drill string itself.

Third, due to the higher carrier frequencies that can be used with the invention in comparison with prior art telemetry systems, the data transfer rate using the invention is potentially much higher than with prior art systems. In the preferred embodiment using a carrier frequency of about 400 kilohertz, data transfer rates of more than 38,400 bits per second have been achieved.

This distinction inherently offers the potential for more efficient drilling operations because information can possibly be communicated to and from the surface communications system (not shown) much quicker than with prior art systems.

This distinction, coupled with the low power requirements of the axial conducting loop (42) also offers the potential for extended life of the batteries making up the power supplies (156,170), since information need not be communicated continuously but may be communicated intermittently according to a predetermined transmit duty cycle due to the high data transfer rates that can be achieved. By limiting the conducting of the transmitter electrical signal during the transmit duty cycle, the average power consumption of the system can be further reduced, with the result that drilling operations can be prolonged before the drilling assembly must be removed from the borehole to change batteries.

The embodiments of the invention in which an exclusive property or privilege is claimed are defined as follows:

1. A method for communicating information axially along a drill string, comprising the step of conducting an axial electrical signal embodying the information between a first axial position in the drill string and a second axial position in the drill string through an axial conducting loop formed by the drill string, which axial conducting loop extends between the first axial position and the second axial position, wherein the drill string between the first axial position and the second axial position comprises an outer axial conductor and an inner axial conductor rotationally supported within the outer axial conductor and wherein the axial conducting loop is comprised of the inner axial conductor and the outer axial conductor.

2. The method as claimed in claim 1 wherein the drill string is comprised of a housing and wherein the outer axial conductor is comprised of the housing.

3. The method as claimed in claim 2 wherein the drill string is further comprised of a drive train rotationally supported within the housing and wherein the inner axial conductor is comprised of the drive train.

4. The method as claimed in claim 1 wherein the inner axial conductor and the outer axial conductor are conductively connected with each other at each of the first axial position and the second axial position.

5. The method as claimed in claim 4 further comprising the step of inducing from the conducting of the axial electrical signal the conducting through a receiver conductor of a receiver electrical signal embodying the information.

6. The method as claimed in claim 4 further comprising the following steps:

(a) conducting through a transmitter conductor a transmitter electrical signal embodying the information; and (b) inducing from the conducting of the transmitter electrical signal the conducting through the axial conducting loop of the axial electrical signal.

7. The method as claimed in claim 6 further comprising the step of inducing from the conducting of the axial electrical signal the conducting through a receiver conductor of a receiver electrical signal embodying the information.

8. The method as claimed in claim 7 further comprising the following steps before conducting the transmitter electrical signal through the transmitter conductor:

(a) receiving the information; and (b) generating the transmitter electrical signal.

9. The method as claimed in claim 8 further comprising the step after conducting the receiver electrical signal through the receiver conductor of obtaining the information from the receiver electrical signal.

10. The method as claimed in claim 9 wherein the transmitter conductor is comprised of a transmitter coil comprising a plurality of windings.

11. The method as claimed in claim 10 wherein the receiver conductor is comprised of a receiver coil comprising a plurality of windings.

12. The method as claimed in claim 11 wherein the transmitter conductor further comprises a magnetically permeable toroidal transmitter core and wherein the windings of the transmitter coil are wrapped around the transmitter core.

13. The method as claimed in claim 12 wherein the receiver conductor further comprises a magnetically permeable toroidal receiver core and wherein the windings of the receiver coil are wrapped around the receiver core.

14. The method as claimed in claim 13 wherein the inner axial conductor is comprised of components of a drive train for a downhole motor drilling assembly.

15. The method as claimed in claim 14 wherein the outer axial conductor is comprised of a housing for the downhole motor drilling assembly.

16. The method as claimed in claim 15 wherein the downhole motor drilling assembly defines an annular transmitter space between the drive train and the housing and defines an annular receiver space between the drive train and the housing and wherein the transmitter conductor and the receiver conductor are located in the annular transmitter space and the annular receiver space respectively.

17. The method as claimed in claim 16 wherein the transmitter conductor and the receiver conductor are located between the first axial position and the second axial position.

18. The method as claimed in claim 17 wherein the transmitter electrical signal is comprised of a varying electrical signal having a carrier frequency of between about 10 kilohertz and about 2 megahertz.

19. The method as claimed in claim 18 wherein the transmitter electrical signal has a voltage of between about 2 volts (peak) and about 10 volts (peak).

20. The method as claimed in claim 19 wherein the transmitter electrical signal is a unipolar varying electrical signal.

21. A telemetry system for communicating information axially along a drill string, the system comprising:

(a) an axial conducting loop formed by the drill string for conducting an axial electrical signal embodying the information between a first axial position in the drill string and a second axial position in the drill string, which axial conducting loop extends between the first axial position and the second axial position; and (b) a transmitter for transmitting the information to the axial conducting loop; and wherein the drill string between the first axial position and the second axial position comprises an outer axial conductor and an inner axial conductor rotationally supported within the outer axial conductor and wherein the axial conducting loop is comprised of the inner axial conductor and the outer axial conductor.

22. The system as claimed in claim 4 wherein the drill string is comprised of a housing and wherein the outer axial conductor is comprised of the housing.

23. The system as claimed in claim 4 wherein the drill string is further comprised of a drive train rotationally supported within the housing and wherein the inner axial conductor is comprised of the drive train.

24. The system as claimed in claim 21 further comprising a receiver for receiving the information from the axial conducting loop.

25. The system as claimed in claim 24 wherein the transmitter is located adjacent to one of the first axial position and the second axial position and wherein the receiver is located adjacent to the other of the first axial position and the second axial position.

26. The system as claimed in claim 25 wherein the axial conducting loop is further comprised of a first conductive connection between the inner axial conductor and the outer axial conductor at the first axial position and is further comprised of a second conductive connection between the inner axial conductor and the outer axial conductor at the second axial position.

27. The system as claimed in claim 26 wherein the transmitter is comprised of a transmitter conductor for conducting a transmitter electrical signal embodying the information such that conducting of the axial electrical signal in the axial conducting loop will be induced from the conducting of the transmitter electrical signal in the transmitter conductor.

28. The system as claimed in claim 27 wherein the receiver is comprised of a receiver conductor for conducting a receiver electrical signal embodying the information such that conducting of the receiver electrical signal in the receiver conductor will be induced from the conducting of the axial electrical signal in, the axial conducting loop.

29. The system as claimed in claim 28 wherein the transmitter conductor is comprised of a transmitter coil comprising a plurality of windings.

30. The system as claimed in claim 29 wherein the receiver conductor is comprised of a receiver coil comprising a plurality of windings.

31. The system as claimed in claim 30 wherein the transmitter conductor further comprises a magnetically permeable toroidal transmitter core and wherein the windings of the transmitter coil are wrapped around the transmitter core.

32. The system as claimed in claim 31 wherein the receiver conductor further comprises a magnetically permeable toroidal receiver core and wherein the windings of the receiver coil are wrapped around the receiver core.

33. The system as claimed in claim 32 wherein the inner axial conductor is comprised of components of a drive train for a downhole motor drilling assembly.

34. The system as claimed in claim 33 wherein the outer axial conductor is comprised of a housing for the downhole motor drilling assembly.

35. The system as claimed in claim 34 wherein the downhole motor drilling assembly defines an annular transmitter space between the drive train and the housing and defines an annular receiver space between the drive train and the housing and wherein the transmitter conductor and the receiver conductor are located in the annular transmitter space and the annular receiver space respectively.

36. The system as claimed in claim 35 wherein the transmitter conductor and the receiver conductor are located between the first axial position and the second axial position.

37. The system as claimed in claim 36 wherein the transmitter further comprises a transmitter processor for receiving the information and for generating the transmitter electrical signal.

38. The system as claimed in claim 37 wherein the receiver further comprises a receiver processor for receiving the receiver electrical signal and for obtaining the information from the receiver electrical signal.

39. The system as claimed in claim 38 wherein the receiver is a transceiver which is capable of both transmitting and receiving the information.

40. The system as claimed in claim 38 wherein the transmitter is a transceiver which is capable of both transmitting and receiving the information.

41. The system as claimed in claim 40 wherein the receiver is a transceiver which is capable of both transmitting and receiving the information.

* * * * *

UNITED STATES PATENT AND TRADEMARK OFFICE

CERTIFICATE OF CORRECTION

PATENT NO. : 6,392,561 B1
DATED : May 21, 2002
INVENTOR(S) : Evan L. Davies et al.

It is certified that error appears in the above-identified patent and that said Letters Patent is hereby corrected as shown below:

Title page,
Insert -- [30] Foreign Application Priority Data
Dec. 18, 1998 (CA) ..... 2256557 --.

Column 1,
Line 13, before "system" insert -- MWD --.

Column 28,
Line 31, delete "4" and insert -- 21 --.
Line 34, delete "4" and insert -- 22 --.

Signed and Sealed this

Twelfth Day of November, 2002

*Attest:*

*Attesting Officer*

JAMES E. ROGAN
*Director of the United States Patent and Trademark Office*